US012576299B2

(12) United States Patent
Netter et al.

(10) Patent No.: US 12,576,299 B2
(45) Date of Patent: Mar. 17, 2026

(54) EXERCISE AND THERAPY DEVICE

(71) Applicant: Jean-Patrick Netter, Encinitas, CA (US)

(72) Inventors: Jean-Patrick Netter, Encinitas, CA (US); Dorian Alberti, Madison, FL (US); John Michael Davis, Las Vegas, NV (US); Mallory E. Warren, La Mesa, CA (US)

(73) Assignee: Jean-Patrick Netter, Encinitas, CA (US)

( * ) Notice: Subject to any disclaimer, the term of this patent is extended or adjusted under 35 U.S.C. 154(b) by 0 days.

(21) Appl. No.: 19/094,110

(22) Filed: Mar. 28, 2025

(65) Prior Publication Data

US 2025/0303218 A1 Oct. 2, 2025

Related U.S. Application Data

(60) Provisional application No. 63/571,915, filed on Mar. 29, 2024.

(51) Int. Cl.
*A63B 21/018* (2006.01)
*A63B 21/00* (2006.01)
(Continued)

(52) U.S. Cl.
CPC ..... *A63B 21/018* (2013.01); *A63B 21/00178* (2013.01); *A63B 21/22* (2013.01);
(Continued)

(58) Field of Classification Search
CPC . A63B 21/00178; A63B 21/018; A63B 21/22; A63B 23/04; A63B 2071/065; A63B 2214/00; A63B 2220/34; A63B 2225/74
See application file for complete search history.

(56) References Cited

U.S. PATENT DOCUMENTS 2,638,089 A 5/1953 Murphy
4,558,861 A 12/1985 Gall
(Continued)

FOREIGN PATENT DOCUMENTS

KR 200402125 Y1 11/2005
KR 2014-0006131 A 1/2014

OTHER PUBLICATIONS

Invitation to Pay Additional Search Fees in corresponding International Patent Application No. PCT/US2025/022084, mailed Jul. 1, 2025, in 11 pages.

*Primary Examiner* — Megan Anderson
(74) *Attorney, Agent, or Firm* — Knobbe, Martens, Olson & Bear, LLP

(57) ABSTRACT

A device may include a base, a housing, a first shaft, and a second shaft, a first roller coupled to the first shaft, a second roller coupled to the second shaft, a first resistance that selectively impedes the rotation of the first roller and a second resistance that selectively impedes the rotation of the second roller, wherein the first shaft and second shaft are rotatable independently of each other, the first resistance is adjustable such that increasing the first resistance increases a force required to rotate the first roller and decreasing the first resistance decreases the force required to rotate the first roller, the second resistance is adjustable such that increasing the second resistance increases a force required to rotate the second roller and decreasing the second resistance decreases the force required to rotate the second roller, and the first resistance and the second resistance are independently adjustable.

20 Claims, 16 Drawing Sheets

(51) Int. Cl.
*A63B 21/22* (2006.01)
*A63B 23/04* (2006.01)
*A63B 71/06* (2006.01)

(52) U.S. Cl.
CPC ..... *A63B 23/04* (2013.01); *A63B 2071/065* (2013.01); *A63B 2214/00* (2020.08); *A63B 2220/34* (2013.01); *A63B 2225/74* (2020.08)

(56) References Cited

U.S. PATENT DOCUMENTS

| | | | | |
|---|---|---|---|---|
| 5,251,620 | A | 10/1993 | Boucher et al. | |
| 5,527,247 | A | 6/1996 | Archambault | |
| 5,685,828 | A | 11/1997 | Dyck | |
| 6,056,709 | A | 5/2000 | Hashimoto | |
| D548,352 | S | 8/2007 | Maesawa et al. | |
| 9,446,288 | B1 * | 9/2016 | Pazan | A61H 1/0285 |
| 9,636,271 | B2 | 5/2017 | Lagus | |
| 10,555,868 | B2 | 2/2020 | DiBenedetto | |
| 11,260,255 | B2 * | 3/2022 | Short | A63B 21/00192 |
| 11,285,068 | B2 | 3/2022 | Powell | |
| 11,826,610 | B2 | 11/2023 | Griffin | |
| 2007/0129654 | A1 | 6/2007 | Anderson, Jr. | |
| 2010/0029449 | A1 | 2/2010 | Kim | |
| 2017/0252603 | A1 * | 9/2017 | Wu | A63B 23/04 |
| 2019/0038226 | A1 * | 2/2019 | Davidson | B29C 59/026 |
| 2019/0329083 | A1 | 10/2019 | Baumler et al. | |
| 2023/0248607 | A1 | 8/2023 | Chen | |

* cited by examiner

EXERCISE AND THERAPY DEVICE

PRIORITY CLAIM AND INCORPORATION BY REFERENCE

This application claims priority to U.S. Provisional Patent Application No. 63/571,915, filed Mar. 29, 2024, the contents of which are incorporated by reference as if fully set forth herein.

FIELD

The present disclosure generally relates to exercise and therapy devices and methods of using the same.

BACKGROUND

Many individuals spend much of their time sitting, living primarily sedentary lives with minimal exercise. This can lead to various health issues such as poor circulation, weight gain, and/or chronic pain, especially in the feet and legs. Many conventional exercise techniques and devices that target the feet and legs are often inconvenient or uncomfortable to utilize while sitting. Traditional sitting exercise devices that target the feet and/or legs can be expensive, heavy, and/or cumbersome to deploy. For example, sitting treadmills are expensive to manufacture, heavy, and cumbersome to move and deploy, especially for the elderly or infirm. Furthermore, sitting treadmills can prove uncomfortable to use due to the unnatural angle between a sitting user's feet/legs and the relatively flat treadmill surface. Additionally, traditional sitting exercise devices for the feet and/or legs can fail to provide independent exercise regimen for each foot and/or leg that can be tailored to the needs of each foot and/or leg individually. For example, sitting treadmills can require a user to move both feet and/or legs at the same pace. Thus, there exists a need for an affordable, easily portable device that permits sitting exercise while maintaining the comfort of the user and providing independent exercise options for each foot and/or leg. Disclosed herein are exercise and therapy devices and methods of using the same that address at least the foregoing issues.

SUMMARY OF SOME EXAMPLE EMBODIMENTS

Disclosed herein are embodiments of an exercise device. In any embodiments disclosed herein, the exercise device can be used for therapy and can, therefore, also be referred to herein as a therapy device. In some embodiments, the exercise and therapy device can include a pair of rollers that can be rotated by a user's feet and/or legs to exercise and massage a user's feet and/or legs. The rollers can be operated and/or controlled independently from each other such that the rollers can be rotated at different speeds and/or in different directions simultaneously. The rotation of the rollers can be impeded by a resistance that affects the amount of force required to rotate the rollers. The resistance impeding rotation of the rollers can be adjusted to change the amount of force required to rotate the rollers, increasing or decreasing the difficulty of the exercise. In some embodiments, the resistance that impedes the rotation of each roller can be independently adjusted, such that the force required to rotate one roller can be adjusted without changing the force required to rotate another roller. This can permit a user to tailor the difficulty of the exercise to the needs of each foot and/or leg. In other embodiments, the exercise device can be configured such the resistance that impedes the rotation of each roller can be simultaneously adjusted. The rollers can include surface features such as a plurality of projections to massage a user's feet and/or legs when they are in contact with the rollers.

In some embodiments, the exercise and therapy device can include a base, a housing coupled to the base, a first shaft extending from a first side of the housing, a second shaft extending from a second side of the housing opposite the first side of the housing, the second shaft being coaxial with the first shaft, a first roller coupled to the first shaft such that a rotation of the first roller causes an equal and simultaneous rotation of the first shaft, a second roller coupled to the second shaft such that a rotation of the second roller causes an equal and simultaneous rotation of the second shaft, a first resistance that selectively impedes the rotation of the first roller, and a second resistance that selectively impedes the rotation of the second roller, wherein the first and second shafts can be rotated in either a clockwise or a counterclockwise direction, the first shaft is rotatable independently of the second shaft and the second shaft is rotatable independently of the first shaft, the first resistance is adjustable such that increasing the first resistance increases a force required to rotate the first roller and decreasing the first resistance decreases the force required to rotate the first roller, the second resistance is adjustable such that increasing the second resistance increases a force required to rotate the second roller and decreasing the second resistance decreases the force required to rotate the second roller, and the first resistance and the second resistance are independently adjustable.

In some embodiments of the exercise and therapy device disclosed herein, the first roller can include an outer surface and a plurality of projections extending outwardly away from the outer surface of the first roller, and the second roller can include an outer surface and a plurality of projections extending outwardly away from the outer surface of the second roller.

In some embodiments, the exercise and therapy device can further include a first friction member configured to exert a first frictional force on the first shaft, a second friction member configured to exert a second frictional force on the second shaft, wherein the first frictional force is adjustable such that increasing the first frictional force increases the first resistance and decreasing the first frictional force decreases the first resistance, the second frictional force is adjustable such that increasing the second frictional force increases the second resistance and decreasing the second frictional force decreases the second resistance, and the first frictional force and the second frictional force are independently adjustable.

In some embodiments of the exercise and therapy device disclosed herein, the first friction member can include a first belt, and the second friction member can include a second belt.

In some embodiments, the exercise and therapy device can further include a first actuator configured to adjust the tension of the first belt, a second actuator configured to adjust the tension of the second belt, wherein increasing the tension of the first belt increases the first frictional force and decreasing the tension of the first belt decreases the first frictional force, and increasing the tension in the second belt increases the second frictional force and decreasing the tension in the second belt decreases the second frictional force.

In some embodiments of the exercise and therapy device disclosed herein, the first actuator can include a first arm, the first arm being configured to extend and retract, the second actuator can include a second arm, the second arm configured to extend and retract, the first belt is coupled to the first arm, the second belt is coupled to the second arm, extending the first arm increases the tension in the first belt and retracting the first arm decreases the tension in the first belt, and extending the second arm increases the tension in the second belt and retracting the second arm decreases the tension in the second belt.

In some embodiments, the exercise and therapy device can further include a plurality of light emitters configured to emit light with a wavelength between 600 nm and 850 nm, the plurality of light emitters being positioned beneath a transparent or semi-transparent top surface of the base.

In some embodiments of the exercise and therapy device disclosed herein, the first roller further can include a first plurality of light emitters configured to emit light with a wavelength between 600 nm and 850 nm, and the second roller can further include a second plurality of light emitters configured to emit light with a wavelength between 600 nm and 850 nm.

In some embodiments of the exercise and therapy device disclosed herein, the first roller is approximately cylindrical in shape, the first roller including a variable diameter, a first and second end of the first roller have a first, maximum diameter, portions of the first roller between the first and second ends have diameters that are less than the first, maximum diameter, and a center portion of the first roller is located approximately halfway between the first and second end of the first roller and has a diameter that is greater than the diameter of portions of the first roller adjacent to the center portion.

In some embodiments, the exercise and therapy device can further include a first base portion including a first end and a second end, and a second base portion including a first end and a second end, wherein the first base portion and the second base portion are positioned on opposite, lateral sides of the housing, the first base portion is tapered such that the first end of the first base portion is narrower than the second end of the first base portion, the second base portion is tapered such that the first end of the second base portion is narrower than the second end of the second base portion, In some embodiments, the exercise and therapy device can further include a first base portion including a first plurality of light emitters, and a transparent or semi-transparent top surface, and a second base portion including a second plurality of light emitters, and a transparent of semi-transparent top surface, wherein the first base portion and the second base portion are positioned on opposite, lateral sides of the housing, and the first plurality of light emitters and the second plurality of light emitters are configured to emit light with a wavelength between 600 nm and 850 nm.

In some embodiments, the exercise and therapy device can further include one or more displays configured to display a first numerical value representing the first resistance and a second numerical value representing the second resistance.

In some embodiments, the exercise and therapy device can further include a first sensor configured to emit a signal when the first shaft completes a rotation, and a second sensor configured to emit a signal when the second shaft completes a rotation.

In some embodiments, the techniques described herein relate to a method for exercising at least a user's lower legs, including applying a first force to a first roller to rotate the first roller, wherein a rotation of the first roller is resisted by a first resistance force, applying a second force to rotate a second roller, wherein a rotation of the second roller is resisted by a second resistance force, increasing the first resistance force independently of the second resistance force to increase a force required to rotate the first roller without changing the second resistance force.

In some embodiments, the techniques described herein relate to a method, wherein applying the first force to the first roller rotates a first shaft, wherein a rotation of the first shaft is resisted by a first frictional force, and applying the second force to the second roller rotates a second shaft, wherein a rotation of the second shaft is resisted by a second frictional force.

In some embodiments, the techniques described herein relate to a method, which can further include increasing the first frictional force independently of the second frictional force to increase a force required to rotate the first shaft without changing the second frictional force, wherein increasing the first frictional force increases the first resistance force.

In some embodiments, the techniques described herein relate to a method, which can further include increasing a tension of a first friction member to increase the first frictional force independently of the second frictional force.

In some embodiments, the techniques described herein relate to a method, wherein the first friction member includes a belt.

In some embodiments, the techniques described herein relate to a method, wherein increasing the tension of the first friction member includes extending a first actuator coupled to the first friction member.

In some embodiments, the techniques described herein relate to a method, further including emitting light between 600 nm and 850 nm, wherein the light is emitted by a plurality of light emitters.

BRIEF DESCRIPTION OF THE DRAWINGS

Various embodiments are depicted in the accompanying drawings for illustrative purposes, and should in no way be interpreted as limiting the scope of the embodiments. Various features of different disclosed embodiments can be combined to form additional embodiments, which are part of this disclosure.

DETAILED DESCRIPTION OF SOME EXAMPLE EMBODIMENTS

Figure 1:
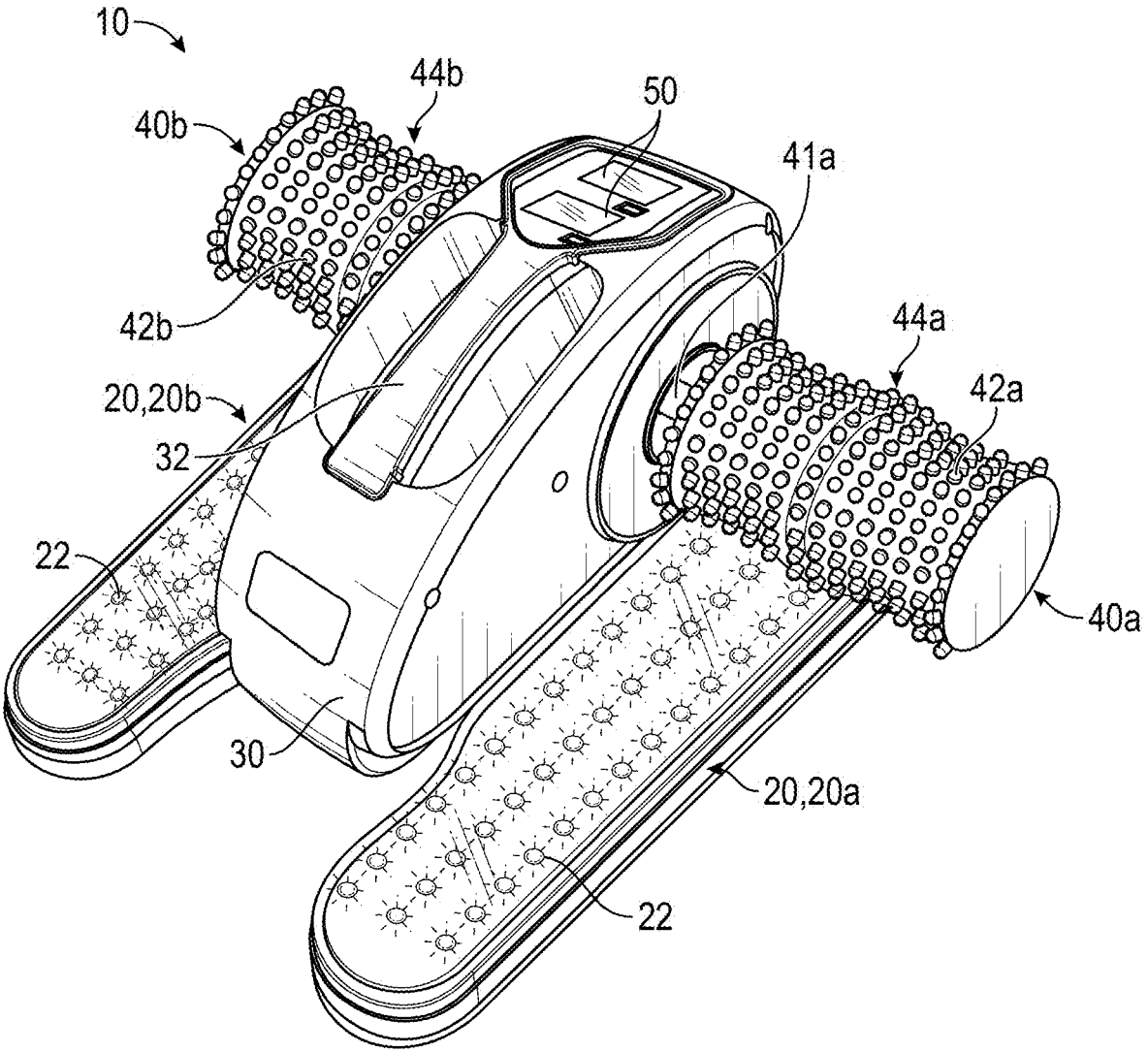
FIG. 1 illustrates a front, top perspective view of an embodiment of an exercise and therapy device.

Disclosed herein are various embodiments of an exercise and therapy device and methods of using the same. Any of the embodiments of the exercise and therapy device can provide exercise, physical therapy, and massage to portions of the user's body, for example, the user's feet and/or legs. In some embodiments of the exercise and therapy device disclosed herein, the device is configured to be used while a user is seated. The disclosed exercise and therapy devices can be transported easily due to their light weight and compact size. Some embodiments of the disclosed exercise and therapy device disclosed herein can include a pair of rollers that can be rotated independently of each other such that each roller can be rotated at different speeds and/or in different directions. A user can rotate one or more roller(s) by contacting the roller(s) with his or her feet and/or legs and using his or her feet and/or legs to exert a force on the roller(s). Rotating the rollers can exercise and/or massage a user's feet and/or legs. The rollers can be rotated in the same direction or in opposite directions simultaneously. The rollers can be rotated at the same speed or at different speeds.

The rotation of the rollers can be impeded by an adjustable resistance such that the force required to rotate each roller can be adjusted—e.g., increased or decreased. In some embodiments, the resistance acting against the rotation of each roller can be independently adjusted such that the force required to rotate each roller can be independently changed without changing the amount of force required to rotate the other roller. The rollers can include textured surfaces with a plurality of projections (also referred to herein as protrusions) and/or recesses to massage a user's feet and/or legs when a user's feet and/or legs are in contact with the rollers. Some embodiments of the exercise and therapy devices can include a plurality of light emitters that can emit red light to provide red light therapy. A user can position his or her feet proximate the light emitters such that the red light is at least partially received by a user's feet. Additionally, in some embodiments, the exercise and therapy devices can include gamified engagement including progress tracking and real-time feedback to increase user engagement.

FIGS. 1-6 illustrate various views of an embodiment of the exercise and therapy device 10. In some embodiments, the exercise and therapy device 10 can include a base 20, a housing 30, a first roller 40*a*, a second roller 40*b*, a first shaft (e.g., axle) 41*a*, and a second shaft (e.g., axle) 41*b*. The first roller 40*a* and the second roller 40*b* are collectively referred to herein as the rollers 40. In some embodiments, the first roller 40*a* can include a contact surface (e.g., outer surface) 44*a* and/or one or a plurality of surface features 42*a*. Similarly, in some embodiments, the second roller 40*b* can include a contact surface 44*b* (e.g., outer surface) and/or one or a plurality of surface features 42*b*.

In some embodiments, the base 20 can rest on a support surface, such as the ground, to support the exercise and therapy device 10. In some embodiments, a top surface of the base 20 can be substantially planar. In some embodiments, the top surface of the base 20 can be substantially parallel to the support surface the base 20 rests upon. A user can place one or both feet on the base 20 to rest his or her feet and/or legs when not exercising. In some embodiments, a user can place one or both feet on a top surface of the base 20 such that the bottom or one or both feet contacts the top surface of the base 20.

In some embodiments, the base 20 can include first and second base portions 20*a*, 20*b*. In some embodiments, a top surface of the base portion 20*a* can be substantially planar. In some embodiments, a top surface of the base portion 20*b* can be substantially planar. In some embodiments, the top surfaces of the base portions 20*a*, 20*b* can be substantially parallel to each other. In some embodiments, the top surfaces of the base portions 20*a*, 20*b* can be substantially parallel to the support surface. In some embodiments, the top surfaces of the base portions 20*a*, 20*b* can be angled relative to the support surface. For example, the top surfaces of the base portions 20*a*, 20*b* can be angled toward a user such that a user's heels are lower than a user's toes when a user's feet are positioned on the base portions 20*a*, 20*b*. The base portions 20*a*, 20*b* can be positioned on opposite, lateral sides of the housing 30. For example, the base portion 20*a* can be positioned on a right side of the housing 30, and the base portion 20*b* can be positioned on a left side of the housing 30.

In some embodiments, the base portions 20*a*, 20*b* can have an approximately rectangular shape with rounded corners. In some embodiments, the first base portion 20*a* can include a first end and a second end. For example and without limitation, the first end of the first base portion 20*a* is a proximal end (closest to a front of the device and a seated user), and the second end of the first base portion 20*a* is a distal end (furthest from the front of the device and a seated user). In some embodiments, the second base portion 20*b* can include a first end and a second end. For example and without limitation, the first end of the second base portion 20*b* is a proximal end (closest to a front of the device and a seated user), and the second end of the second base portion 20*b* is a distal end (furthest from the front of the device and a seated user). In some embodiments, the proximal end of the base portions 20*a*, 20*b* can be narrower than the distal end of the base portions 20*a*, 20*b*. In some embodiments, the proximal end of the base portions 20*a*, 20*b* can be rounded. In some embodiments, the distal end of the base portions 20*a*, 20*b* can be rectangular with rounded corners. In some embodiments, the width of the base portions 20*a*, 20*b* can taper toward the proximal end of the base portions 20*a*, 20*b* such that the proximal ends of the base portions 20*a*, 20*b* are narrower than the distal ends of the base portions 20*a*, 20*b*.

In some embodiments, the first base portion 20*a* can include a first side and a second side. For example and without limitation, the first side of the first base portion 20*a* is a lateral side (furthest from the housing 30), and the second side of the first base portion 20*a* is a medial side (closest to the housing). In some embodiments, the second base portion 20*b* can include a first side and a second side. For example and without limitation, the first side of the second base portion 20*b* is a lateral side (furthest from the housing 30), and the second side of the second base portion 20*b* is a medial side (closest to the housing). In some embodiments, the lateral side of the first base portion 20*a* can be parallel or substantially parallel to the lateral side of the second base portion 20*b*. In some embodiments, a portion of the medial side of the first base portion 20*a* can angle toward the lateral side of the first base portion 20*a* proximate the proximal end of the first base portion 20*a* such that the width of the first base portion 20*a* tapers toward the proximal end of the first base portion 20*a*. In some embodiments, a portion of the medial side of the second base portion 20*b* can angle toward the lateral side of the second base portion 20*b* proximate the proximal end of the second base portion 20*b* such that the width of the second base portion 20*b* tapers toward the proximal end of the second base portion 20*b*. In some embodiments, the base portions 20*a*, 20*b* can be sized and/or shaped such that a user can position one foot on a top surface of each base portion 20*a*, 20*b*. For example, a user can position his or her left foot on base portion 20*b* such that the bottom of the user's left foot contacts a top surface of the base portion 20*b*. A user can position his or her right foot on base portion 20*a* such that the bottom of the user's right foot contacts a top surface of the base portion 20*a*.

In some embodiments, the exercise and therapy device 10 can include a plurality of light emitters 22. In some embodiments, the base 20 and/or the base portions 20*a*, 20*b* can include a transparent or semi-transparent top surface. The base 20 and/or the base portions 20*a*, 20*b* can include a plurality of light emitters 22. In some embodiments, the light emitters 22 can be positioned beneath the transparent or semi-transparent top surface of the base 20 and/or base portions 20*a*, 20*b* such that at least some of the light emitted from the light emitters 22 escapes from (e.g., passes through) the top surface of the base 20 and/or the base portions 20*a*, 20*b*. In some embodiments, substantially all or at least a majority of the light emitted from the light emitters 22 passes through the top surface of the base 20 and/or the base portions 20*a*, 20*b* A user can place his or her feet on the top surface of the base 20 and/or the base portions 20*a*, 20*b* such that at least some of the light emitted from the light emitters 22 is received by the user's foot or feet. In some embodiments, substantially all or at least a majority of the light emitted from the light emitters 22 is received by the user's foot or feet.

In some embodiments, the device is configured (e.g., without limitation, using one or more sensors such as pressure sensors) to determine when a user's foot is placed on the base 20 and/or the base portions 20*a*, 20*b*. In some embodiments, the device is selectively configured to activate or turn on one or a plurality of light emitters 22 when the user's foot is placed on the base 20 and/or the base portions 20*a*, 20*b* and to selectively deactivate or turn off the one or the plurality of light emitters 22 when the user's foot is removed from the base 20 and/or the base portions 20*a*, 20*b*. In this arrangement, the device can be configured to automatically activate or turn on the one or the plurality of light emitters 22 simply by placing the user's foot or feet on the base 20 and/or the base portions 20*a*, 20*b* and to deactivate or turn off the one or the plurality of light emitters 22 simply by removing the user's foot or feet from the base 20 and/or the base portions 20*a*, 20*b*. In any embodiments disclosed herein, the one or the plurality of light emitters 22 of the first and second base portions 20*a*, 20*b* can be independently activated (e.g., the one or the plurality of light emitters of the first portion can be activated or deactivated independently of the one or the plurality of light emitters of the second portion, and vice versa).

In some embodiments, the light emitters 22 can emit light that promotes healing and/or therapeutic benefits to the user. In some embodiments, the light emitters 22 can emit light that is substantially red in color. In some embodiments, the light emitters 22 can be red light diodes. In some embodiments, the light emitters 22 emit light with a wavelength that is between about 600 nm to 850 nm. In some embodiments, the wavelength of the light emitted by the light emitters 22 is between approximately 600 nm and approximately 850 nm, for example, between approximately 650 nm and approximately 800 nm, between approximately 700 nm and approximately 750 nm, or any value or range between any of these values or ranges or any value or range bounded by any combination of these values, although values and ranges outside these values or ranges can be used in some cases. In some embodiments, the intensity of light emitted by the light emitters 22 can be adjusted to increase and/or decrease the light emitted. The light emitted by the light emitters 22 can reduce inflammation, reduce pain, increase muscle recovery, and/or increase ATP production. In some embodiments, the light emitters 22 can include a self-contained power source. In some embodiments, the self-contained power source of the light emitters 22 can be independently charged. In some embodiments, a plurality of the light emitters 22 can be positioned on or otherwise coupled with the roller 40*a*. In some embodiments, a plurality of the light emitters 22 can be positioned on or otherwise coupled with the roller 40*b*.

In some embodiments, the housing 30 can be coupled to the base 20 and/or the base portions 20*a*, 20*b* such that the housing 30 extends away from the base 20 and/or the base portions 20*a*, 20*b*. The housing 30 can house various electronic and/or mechanical components to shield the components and/or protect a user from injuring themselves on the components. A first shaft 41*a* and/or a second shaft 41*b* can be at least partially disposed within the housing 30. A portion of a first shaft 41*a* and/or a portion of a second shaft 41*b* can extend from the housing 30. In some embodiments, portions of the shafts 41*a*, 41*b* can extend from opposite, lateral sides of the housing 30 such that a portion of the first shaft 41*a* and a portion of the second shaft 41*b* extend from the sides of the housing 30 in substantially opposite directions. The shafts 41*a*, 41*b* can be oriented such that they are substantially parallel to the base 20. In some embodiments, the shafts 41*a*, 41*b* can be oriented such that they are substantially parallel to the ground when the base 20 contacts the ground. In some embodiments, the shafts 41*a*, 41*b* can be oriented at an angle to the base 20 such that the shafts 41*a*, 41*b* are angled with respect to the ground when the base 20 contacts the ground. The shafts 41*a*, 41*b* can be positioned above the base 20 such that there is a gap between the shafts 41*a*, 41*b* and the base 20.

In some embodiments, the first shaft 41*a* can be rotated in a forward or backward direction. In some embodiments, the second shaft 41*b* can be rotated in a forward or backward direction. In some embodiments, the first shaft 41*a* is rotatable independently of the second shaft 41*b*. In some embodiments, the second shaft 41*b* is rotatable independently of the first shaft 41*a*. In some embodiments, the shafts 41*a*, 41*b* can be disconnected or separate from each other such that each of the shafts 41*a*, 41*b* can be free to rotate independently of each other. For example, one of the shafts 41*a*, 41*b* can rotate while the other shaft 41*a*, 41*b* is stationary. For example, one of the shafts 41*a*, 41*b* can rotate in a first direction while the other shaft 41*a*, 41*b* rotates in a second, opposite direction. For example, one of the shafts 41*a*, 41*b* can rotate at a first speed while the other shaft 41*a*, 41*b* rotates at a second, different speed. In some embodiments, the shafts 41*a*, 41*b* can be coaxial such that the first shaft 41*a* and second shaft 41*b* can rotate about the same axis of rotation. In some embodiments, the shafts 41*a*, 41*b* can be arranged such that they are not collinear such that the first shaft 41*a* and the second shaft 41*b* can rotate about different axes of rotation. In some embodiments, the device 10 can be configured such that the shafts 41*a*, 41*b* rotate together and in unison.

In some embodiments, the rollers 40*a*, 40*b* can be positioned on opposite lateral sides of the housing 30. This can allow a user to comfortably place a first foot or leg, for example a right foot or leg, on the first roller 40*a* while positioning a second foot or leg, for example a left foot or leg, on the second roller 40*b*. In some embodiments, the rollers 40*a*, 40*b* can be coupled to the shafts 41*a*, 41*b*. In some embodiments, the first roller 40*a* can be coupled to the first shaft 41*a* such that the first roller 40*a* can rotate with the first shaft 41*a* at the same rotational velocity as the first shaft 41*a* and/or about the same axis of rotation as the first shaft 41*a*. In some embodiments, the first roller 40*a* can be coupled to the first shaft 41*a* such that a rotation of the first roller 40*a* causes an equal and simultaneous rotation of the first shaft 41*a*. In some embodiments, the shaft 41*a* can include a key or other insert element that can be fitted in a keyhole of the roller 40*a* such that the shaft 41*a* and the roller 40*a* rotate in unison. In some embodiments, the second roller 40*b* can be coupled to the second shaft 41*b* such that the second roller 40*b* can rotate with the second shaft 41*b* at the same rotational velocity as the second shaft 41*b* and/or about the same axis of rotation as the second shaft 41*b*. In some embodiments, the second roller 40*b* can be coupled to the second shaft 41*b* such that a rotation of the second roller 40*b* causes an equal and simultaneous rotation of the second shaft 41*b*. In some embodiments, the shaft 41*b* can include a key or other insert element that can be fitted in a keyhole of the roller 40*b* such that the shaft 41*b* and the roller 40*b* rotate in unison. In some embodiments, the first roller 40*a* and the second roller 40*b* can rotate about the same axis of rotation which can be defined by the shafts 41*a*, 41*b*.

In some embodiments, the first shaft 41*a* can be at least partially disposed within the first roller 40*a*, and/or the second shaft 41*a* can be at least partially disposed within the second roller 40*b*. In some embodiments, the first shaft 41*a* can at least partially extend through a central axis of the first roller 40*a*, and/or the second shaft 41*b* can at least partially extend through a central axis of the second roller 40*b*. In some embodiments, the first roller 40*a* can be connected to the first shaft 41*a* such that there is a gap between the first roller 40*a* and the housing 30, and/or the second roller 40*b* can be connected to the second shaft 41*b* such that there is a gap between the second roller 40*b* and the housing 30. The rollers 40*a*, 40*b* can be positioned such that there is a gap between the rollers 40*a*, 40*b* and the base 20. The rollers 40*a*, 40*b* can be oriented such that are substantially parallel to the base. In some embodiments, the rollers 40*a*, 40*b* can be oriented such that they are substantially parallel to the ground when the base 20 is in contact with the ground. In some embodiments, the rollers 40*a*, 40*b* can be oriented at an angle to the base such that the roller 40*a*, 40*b* are angled with respect to the ground when the base 20 contacts the ground.

In some embodiments, the first roller 40*a* and the second roller 40*b* can rotate independently of each other. For example, one of the rollers 40*a*, 40*b* can rotate while the other roller 40*a*, 40*b* is stationary. For example, one of the rollers 40*a*, 40*b* can rotate in a first direction while the other roller 40*a*, 40*b* rotates in a second, opposite direction. For example, one of the rollers 40*a*, 40*b* can rotate at a first speed while the other roller 40*a*, 40*b* rotates at a second, different speed. Permitting the rollers 40*a*, 40*b* to rotate independently of each other can permit a user more freedom when using the exercise and therapy device 10 by permitting the user to engage in independent, bilateral lower-body movements where each foot and/or leg can contact and/or rotate a different roller 40*a*, 40*b* at the same or different speeds, the same or different frequencies, and/or the same or different directions. This can improve lower body coordination, help equalize foot and/or leg strength, help recovery from injuries that disproportionately affect one side of the body, improve lower body-flexibility, and/or improve balance. In some embodiments, the device 10 can be configured such that the rollers 40*a*, 40*b* rotate in unison.

In some embodiments, the rollers 40*a*, 40*b* can be approximately cylindrical in shape. In some embodiments, the first roller 40*a* can include a first end and a second end. For example and without limitation, the first end of the first roller 40*a* is a proximal end (closest to the housing 30) and the second end of the first roller 40*a* is a distal end (furthest from the housing 30). In some embodiments, the second roller 40*b* can include a first end and a second end. For example and without limitation, the first end of the second roller 40*b* is a proximal end (closest to the housing 30) and the second end of the second roller 40*b* is a distal end (furthest from the housing 30). In some embodiments, the rollers 40*a*, 40*b* can be approximately cylindrical in shape with a diameter that is variable along a length of the roller 40*a*, 40*b*. For example, the proximal and distal ends of the roller 40*a* can have a first, maximum diameter while inner portions of the roller 40*a* can have diameters that are less than the maximum diameter. The roller 40*a* can have a minimum diameter at one or more locations between the proximal and distal ends of the roller 40*a*. In some embodiments, the diameter of the roller 40*a* at a point approximately half-way between the proximal and distal ends of the roller 40*a* can be greater than the minimum diameter of the roller 40*a*. The diameter of a portion of the roller 40*a* near a center point approximately halfway between the proximal and distal ends of the roller 40*a* can be greater than the diameter of portions of the roller 40*a* adjacent to the center point. In some embodiments, when traversing from the proximal and/or distal end of the roller 40*a* toward a middle of the roller 40*a*, the diameter of the roller 40*a* can initially decrease. In some embodiments, when traversing from the proximal and/or distal end of the roller 40*a* toward a middle of the roller 40*a*, the diameter of the roller 40*a* can increase when nearing the middle of the roller 40*a*. In some embodiments, the roller 40*b* can have a shape that is the same or substantially similar to the shape of the roller 40*a*. In some embodiments, the shape of the roller 40*b* can be different than the shape of the roller 40*a*. The variable-diameter, cylindrical shape of the roller 40*a* and/or roller 40*b* can massage and/or stimulate a user's feet and/or legs to increase user comfort, increase blood flow, increase nerve activation, and/or reduce pain. In some embodiments, the rollers 40*a* and/or 40*b* can be made of rubber and/or plastic.

The roller 40*a* can include a contact surface 44*a*, and/or the roller 40*b* can include a contact surface 44*b*. In some embodiments, the contact surface 44*a* can extend between the top and bottom ends of the roller 40*a*, and/or the contact surface 44*b* can extend between the top and bottom ends of the roller 40*b*. In some embodiments, the contact surface 44*a* and/or 44*b* can be rounded. In some embodiments, a user can place a foot and/or leg on the contact surface 44*a* of roller 40*a* or contact surface 44*b* of roller 40*b*. A user can move his or her foot and/or leg to exert a force on the contact surface 44*a* to rotate roller 40*a* or exert a force on the contact surface 44*b* to rotate roller 40*b*. When a user exerts a force on the contact surface 44*a* or 44*b* using his or her foot and/or leg, the contact surface 44*a* or 44*b* can exert a force on the user's foot and/or leg where the user's foot and/or leg contacts the contact surface 44*a* or 44*b* to massage the user's foot and/or leg. In some embodiments, as a user rotates the roller 40*a* or roller 40*b*, different portions of the contact surface 44*a* or 44*b* can contact different portions of the user's foot and/or leg such that different portions of the user's foot and/or leg are massaged by the contact surface 44*a* or 44*b*. In some embodiments, a user can place his or her other foot and/or leg on the contact surface 44*a* or 44*b* of the other roller 40*a* or 40*b* and move his or her other foot and/or leg in the manner described above to massage his or her other foot and/or leg. In some embodiments, a user can use one foot and/or leg to rotate one roller 40*a* or 40*b* to massage one foot and/or leg at a time. In some embodiments, a user can use both feet and/or legs to rotate both rollers 40*a* and 40*b* simultaneously with each foot and/or leg being positioned on a different roller 40*a* or 40*b* to massage both feet and/or legs at the same time. In some embodiments, a user can contact and/or rotate the rollers 40*a* and/or 40*b* using a body part other than a leg or foot such as an arm and/or a hand to massage that body part. In some embodiments, the contact surfaces 44*a* and/or 44*b* can be made of a material with a high coefficient of friction such that a user's feet are less prone to sliding when rotating the rollers 40*a* and/or 40*b*. In some embodiments, the contact surfaces 44*a* and/or 44*b* can be made of rubber and/or plastic. In some embodiments, the contact surfaces 44*a*, 44*b* can be a different material than the rollers 40*a*, 40*b*. In some embodiments, the contact surfaces 44*a*, 44*b* can be a sleeve and/or tube that can be fitted around the rollers 40*a*, 40*b*.

In some embodiments, the first roller 40*a* can include surface features 42*a*, and/or the second roller 40*b* can include surface features 42*b*. In some embodiments, the surface features 42*a* can be arranged on the contact surface 44*a*. In some embodiments, the surface features 42*b* can be arranged on the contact surface 44*b*. In some embodiments, the surface features 42*a*, 42*b* can be projections, nubs, bumps, and/or recesses. In some embodiments, surface features 42*a* can be a plurality of projections extending outwardly from the contact surface 44*a* of the first roller 40*a*. In some embodiments, the surface features 42*b* can be a plurality of projections extending outwardly from the contact surface 44*b* of the second roller 40*b*. The surface features 42*a* and/or 42*b* can increase the stimulation to a user's feet and/or legs when the user's feet and/or legs are in contact with the contact surfaces 44*a* and/or 44*b*. In some embodiments, the surface features 42*a* and/or 42*b* can increase the pressure exerted on portions of a user's feet and/or legs by decreasing the surface area of the contact surface 44*a* and/or 44*b* that contacts a user's feet and/or legs which can increase blood circulation, reduce pain, stimulate nerves, stimulate key reflexology points, and improve user comfort during use of the exercise and therapy device 10. This can encourage a user to continue exercising by making the exercise experience more enjoyable. In some embodiments, the surface features 42*a* and/or 42*b* can rotate as the rollers 40*a* and/or 40*b* rotate such that the surface features 42*a* and/or 42*b* can contact different portions of a user's feet and/or legs.

In some embodiments, the surface features 42 and/or 42*b* can be arranged on the contact surfaces 44*a* and/or 44*b* in a grid-like pattern. In some embodiments, the surface features 42*a* and/or 42*b* can be arranged on the contact surfaces 44*a* and/or 44*b* such that the surface features 42*a* and/or 42*b* can contact and/or stimulate specific reflexology points in a user's foot. In some embodiments, the surface features 42*a* and/or 42*b* can be circular, ovoid, rectangular, hexagonal, or any other appropriate shape. In some embodiments, the surface features 41*a* and/or 42*b* can include a plurality of shapes and/or such that different portions of the contact surfaces 44*a* and/or 44*b* can include surface features 41*a* and/or 44*b* with different shapes and/or sizes. In some embodiments, the surface features 42*a* and/or 42*b* can be made of rubber and/or plastic. In some embodiments, the surface features 42 can be projections that have a length that is between about ⅛ in. to 1 in. In some embodiments, the length of the projections is between approximately ⅛ in. and approximately 1 in., for example, between approximately ¼ in. and ⅞ in., between approximately ⅜ in. and ¾ in., between approximately ½ in. and ⅝ in., or any value or range between any of these values or ranges or any value or range bounded by any combination of these values, although values and ranges outside these values or ranges can be used in some cases. In some embodiments, the surface features 42*a* and/or 42*b* can include a textured surface to increase grip for a user rotating the roller 40*a* and/or 40*b*.

In some embodiments, the exercise and therapy device 10 can include a plurality of interchangeable rollers 40*a*, 40*b* with different contact surfaces 44*a*, 44*b*, surface features 42*a*, 42*b*, weights, sizes, and/or shapes. In some embodiments, the interchangeable rollers 40*a*, 40*b* can be made of different materials. In some embodiments, the rollers 40*a*, 40*b* can be removably connected to the shafts 41*a*, 41*b* such that a user can detach the rollers 40*a*, 40*b* from the shafts 41*a*, 41*b* and attach a different set of rollers 40*a*, 40*b* with different sizes and/or features. In some embodiments, the roller 40*a* attached to the shaft 41*a* can have different features than the roller 40*b* attached to shaft 41*b*. In some embodiments, the exercise and therapy device 10 can include a plurality of interchangeable contact surfaces 44*a*, 44*b* with different surface features 42*a*, 42*b*, sizes, and/or shapes. In some embodiments, the contact surfaces 44*a*, 44*b* can be made of different materials. In some embodiments, the contact surfaces can be removably attached to the rollers 40*a*, 40*b* such that a user can detach the contact surfaces 44*a*, 44*b* from the rollers 40*a*, 40*b* and attach a different set of contact surfaces 44*a*, 44*b*. In some embodiments, the contact surface 44*a* connected to the roller 40*a* can have different features than the contact surface 44*b* connected to the roller 40*b*. Providing the option to use different interchangeable rollers 40*a*, 40*b* and/or different interchangeable contact surfaces 44*a*, 44*b* can allow a user to customize the exercise and therapy device 10 to better fit his or her individual needs.

In some embodiments, the force required to rotate the rollers 40*a*, 40*b* of the exercise and therapy device 10 can be adjusted. In some embodiments, the force required to rotate each roller 40*a*, 40*b* can be adjusted by increasing or decreasing the resistance acting against the rotation of each roller 40*a*, 40*b*. The resistance acting against the rotation of each roller 40*a*, 40*b* can resist the rotation of the roller 40*a*, 40*b* regardless of the directionality of rotation of the roller 40*a*, 40*b*. In some embodiments, a first resistance can selectively impede the rotation of the first roller 40*a*. In some embodiments, a second resistance can selectively impede the rotation of the second roller 40*b*. Increasing the force required to rotate the rollers 40*a*, 40*b* can increase the intensity of the workout, increasing heart rate, improving circulation and cardiovascular health, facilitating rehabilitation from injuries, and/or promoting muscle growth. Decreasing the force required to rotate rollers 40*a*, 40*b* can decrease the intensity of the workout which some user's may prefer depending on his or her strength and conditioning. In some embodiments, the resistance acting against the rotation of each roller 40*a*, 40*b* can be independently adjusted such that the force required to rotate each roller 40*a*, 40*b* can be different which can allow a user to selectively increase or decrease the difficulty of exercise for his or her left and right feet and/or legs independently. This can be advantageous for people recovering from strokes or injuries that disproportionately impact one side of his or her body. In some embodiments, a user can adjust the resistance in real-time such that the resistance acting against rotation of each roller 40*a*, 40*b* can be adjusted before, during, and/or after an exercise session which can allow a user to change the difficulty of his or her workout during the workout.

Figure 7:
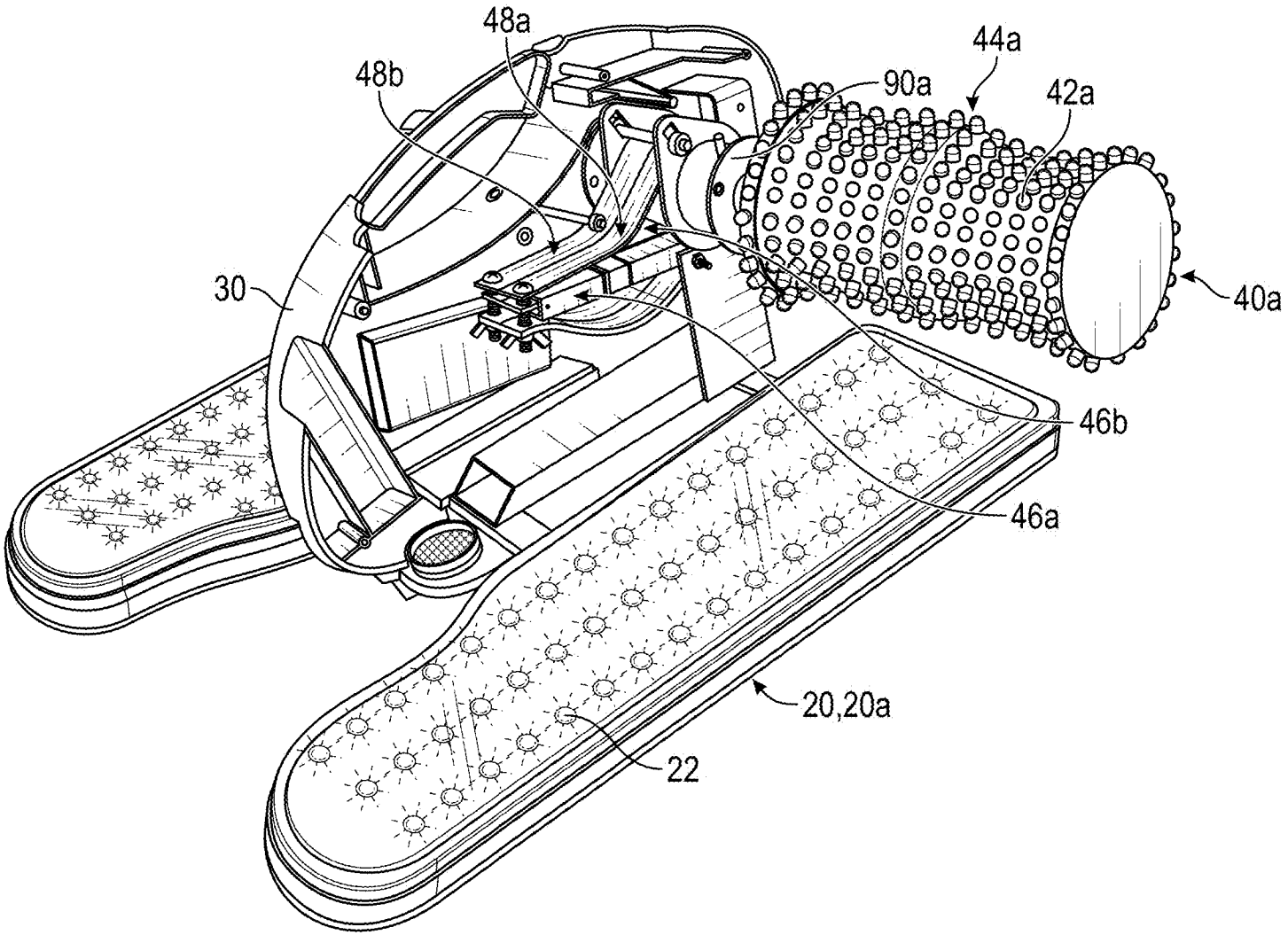
FIG. 7 illustrates a front, top perspective view of the exercise and therapy device of FIG. 1 with a portion of the housing removed.
Figure 8:
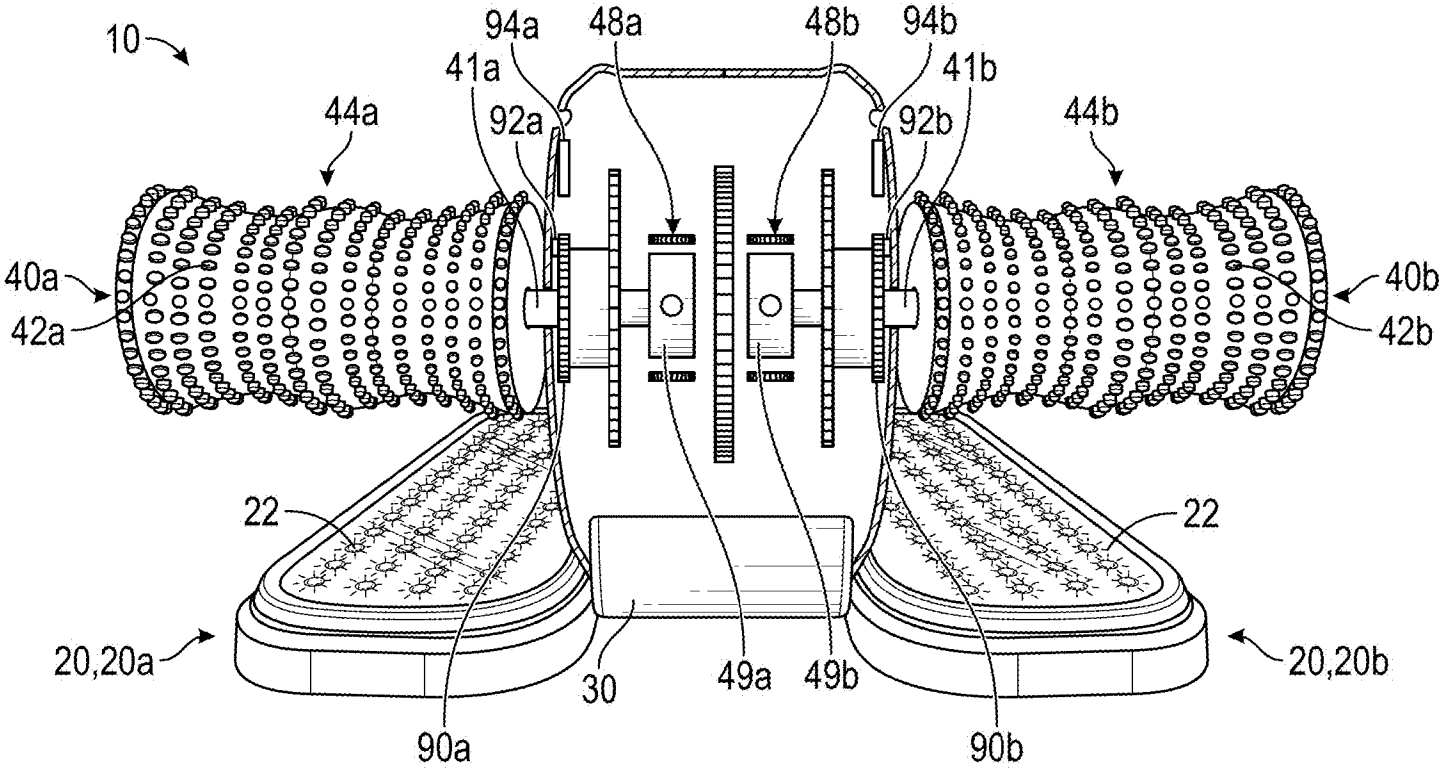
FIG. 8 illustrates a rear view of the exercise and therapy device of FIG. 1 with a portion of the housing removed.

FIG. 7 illustrates an isometric view of the exercise and therapy device 10 with a portion of the housing 30 removed. FIG. 8 illustrates a rear view of the exercise and therapy device 10 with a portion of the housing 30 removed such that certain internal components are visible. In some embodiments, the resistance acting against the rotation of the rollers 40*a*, 40*b* can be modified by adjusting the resistance acting against the rotation of respective, connected shaft 41*a*, 41*b*. In some embodiments, the resistance acting against the rotation of each shaft 41*a*, 41*b* can resist the rotation of the shaft 41*a*, 41*b* regardless of the directionality of rotation of the shaft 41*a*, 41*b*. In some embodiments, the resistance acting against rotation of the shafts 41*a*, 41*b* can be adjusted by increasing or decreasing a frictional force that can resist rotation of the shafts 41*a*, 41*b*. In some embodiments, the frictional force can resist rotation of the shafts 41*a*, 41*b* regardless of the directionality of rotation of the shafts 41*a*, 41*b*.

In some embodiments, friction members 48*a*, 48*b* can apply a frictional force to the shafts 41*a*, 41*b*. For example, the friction member 48*a* can apply a frictional force to shaft 41*a*, and/or the friction member 48*b* can apply a frictional force to shaft 41*b*. The frictional force exerted by the friction members 48*a*, 48*b* can be adjusted to increase or decrease the force required to rotate the shafts 41*a*, 41*b*. In some embodiments, the one or more friction members 48*a*, 48*b* can be belts. In some embodiments, the first friction member 48*a* can at least partially surround the first shaft 41*a*, and/or the second friction member 48*b* can at least partially surround the second shaft 41*b*. In some embodiments, the friction member 48*a* can contact the shaft 41*a* such that a frictional force is created between the friction member 48*a* and the shaft 41*a*, and/or the friction member 48*b* can contact the shaft 41*b* such that a frictional force is created between the friction member 48*b* and the shaft 41*b*. In some embodiments, the friction members 48*a*, 48*b* do not directly contact the shafts 41*a*, 41*b*.

As shown in FIG. 8, in some embodiments, the friction members 48*a*, 48*b* can apply a frictional force to collars 49*a*, 49*b*. For example, the friction member 48*a* can apply a frictional force to collar 49*a*, and/or the friction member 48*b* can apply a frictional force to collar 49*b*. The frictional force between the friction members 48*a*, 48*b* and the collars 49*a*, 49*b* can increase the force required to rotate the collars 49*a*, 49*b*. In some embodiments, the first friction member 48*a* can at least partially surround the collar 49*a*, and/or the second friction member 48*b* can at least partially surround the collar 49*b*. In some embodiments, the friction member 48*a* can contact the collar 49*a* such that a frictional force is created between the friction member 48*a* and the collar 49*a*, and/or the friction member 48*b* can contact the collar 49*b* such that a frictional force is created between the friction member 48*b* and the collar 49*b*. In some embodiments, the shaft 41*a* can be rotatably coupled to the collar 49*a*, and/or the shaft 41*b* can be rotatably coupled to the collar 49*b* such that the frictional force impeding the rotation of the collars 49*a*, 49*b* can also impede rotation of the shafts 41*a*, 41*b*. In some embodiments, the shaft 41*a* can be at least partially disposed in the collar 49*a*, and/or the shaft 41*b* can be at least partially disposed in the collar 49*b*. In some embodiments, the collar 49*a* can surround the shaft 41*a* such that the collar 49*a* contacts the shaft 41*a*, and/or the collar 49*b* can surround the shaft 41*b* such that the collar 49*b* contacts the shaft 41*b*.

In some embodiments, the tension in the friction members 48*a*, 48*b* can be increased or decreased to increase or decrease the frictional force acting on the shafts 41*a*, 41*b*. For example, when the tension in the friction members 48*a*, 48*b* is increased, the normal force exerted by the friction members 48*a*, 48*b* on the collars 49*a*, 49*b* and/or the shafts 41*a*, 41*b* can increase such that the frictional force exerted by the friction members 48*a*, 48*b* can increase. For example, when the tension in the friction members 48*a*, 48*b* is decreased, the normal force exerted by the friction members 48*a*, 48*b* on the collars 49*a*, 49*b* and/or the shafts 41*a*, 41*b* can decrease such that the frictional force exerted by the friction members 48*a*, 48*b* can decrease. In some embodiments, the friction members 48*a*, 48*b* can be made of nylon. In some embodiments, the friction members 48*a*, 48*b* can be made of a mesh or webbing. In some embodiments, the friction members 48*a*, 48*b* can be made of a material with a high coefficient of friction or contain surface features to increase the coefficient of friction. Increasing the coefficient of friction can increase the maximum frictional force exerted by the friction members 48*a*, 48*b*, which can increase the force required to rotate the shafts 41*a*, 41*b* and the rollers 40*a*, 40*b*. In some embodiments, the friction members 48*a*, 48*b* can be stationary relative to the shafts 41*a*, 41*b*.

As shown in FIG. 7, in some embodiments, the exercise and therapy device 10 can include a first actuator 46*a* and/or a second actuator 46*b*. In some embodiments, the tension of the friction members 48*a*, 48*b* can be adjusted by the actuators 46*a*, 46*b*. In some embodiments, the actuators 46*a*, 46*b* can be linear actuators. In some embodiments, the first friction member 48*a* can be coupled to the first actuator 46*a*. In some embodiments, the first actuator 46*a* can be configured to increase and/or decrease the tension in the first friction member 48*a*. In some embodiments, the first actuator 46*a* can include an arm configured to extend and/or retract. In some embodiments, the first friction member 48*a* can be coupled to the arm of the first actuator 46*a* such that the tension in the first friction member 48*a* increases when the arm extends, and/or the tension in the first friction member 48*a* decreases when the arm retracts. In some embodiments, the first actuator 46*a* can be at least partially disposed within the first friction member 48*a*. In some embodiments, the first actuator 46*a* can be positioned such that, when the first actuator 46*a* extends, the arm of the first actuator 46*a* moves away from the first shaft 41*a*. In some embodiments, the first actuator 46*a* can be positioned such that, when the first actuator 46*a* retracts, the arm of the first actuator 46*a* moves toward the first shaft 41*a*. In some embodiments, the first friction member 48*a* can be coupled to the arm of the first actuator 46*a* such that the first friction member 48*a* is pulled when the arm of the first actuator 46*a* extends, increasing the tension in the first friction member 48*a* and increasing the frictional force exerted on the first shaft 41*a*. In some embodiments, the first friction member 48*a* can be coupled to the arm of the first actuator 46*a* such that the first friction member 48*a* is relaxed when the arm of the first actuator 46*a* retracts, decreasing the tension in the first friction member 48*a* and increasing the frictional force exerted on the first shaft 41*a*.

In some embodiments, the second friction member 48*b* can be coupled to the second actuator 46*b*. In some embodiments, the second actuator 46*b* can be configured to increase and/or decrease the tension in the second friction member 48*b*. In some embodiments, the second actuator 46*b* can include an arm configured to extend and/or retract. In some embodiments, the second friction member 48*b* can be coupled to the arm of the second actuator 46*b* such that the tension in the second friction member 48*b* increases when the arm extends, and/or the tension in the second friction member 48*b* decreases when the arm retracts. In some embodiments, the second actuator 46*b* can be at least partially disposed within the second friction member 48*b*. In some embodiments, the second actuator 46*b* can be positioned such that, when the second actuator 46*b* extends, the arm of the second actuator 46*b* moves away from the second shaft 41*b*. In some embodiments, the second actuator 46*b* can be positioned such that, when the second actuator 46*b* retracts, the arm of the second actuator 46*b* moves toward the second shaft 41*b*. In some embodiments, the second friction member 48*b* can be coupled to the arm of the second actuator 46*b* such that the second friction member 48*b* is pulled when the arm of the second actuator 46*b* extends, increasing the tension in the second friction member 48*b* and increasing the frictional force exerted on the second shaft 41*b*. In some embodiments, the second friction member 48*b* can be coupled to the arm of the second actuator 46*b* such that the second friction member 48*b* is relaxed when the arm of the second actuator 46*b* retracts, decreasing the tension in the second friction member 48*b* and decreasing the frictional force exerted on the second shaft 41*b*.

In some embodiments, the exercise and therapy device 10 can utilize alternative methods to independently adjust the force required to rotate each of the rollers 40*a*, 40*b*. For example, the exercise and therapy device 10 can include one or more brakes such as disk brakes, inductive brakes, rim brakes, hydraulic brakes, eddy current brakes, etc. to resist rotation of the shafts 41*a*, 41*b* and/or the rollers 40*a*, 40*b*. In some embodiments, the force applied by the brakes can resist rotation of the shafts 41*a*, 41*b* and/or the rollers 40*a*, 40*b*. In some embodiments, the force applied by the brakes can be independently adjusted such that the force required to rotate each shaft 41*a*, 41*b* and/or each roller 40*a*, 40*b* can be independently adjusted.

In some embodiments, a user can adjust the resistance acting against rotation of each roller 40*a*, 40*b* by interacting with a remote 80 and/or controls located on the exercise and therapy device 10 to increase or decrease the force required to rotate each roller 40*a*, 40*b*. In some embodiments, the remote 80 and/or controls can be configured to extend and/or retract the arms of the actuators 46*a*, 46*b* to increase and/or decrease the tension of the friction members 48*a*, 48*b*, which can increase and/or decrease the friction acting on the shafts 41*a*, 41*b* and/or the resistance acting against rotation of the rollers 40*a*, 40*b*.

In some embodiments, the exercise and therapy device can measure and/or calculate information relating to the rotation of the rollers 40*a*, 40*b* and/or the rotation of the shafts 41*a*, 41*b* such as the total number of rotations, the number of rotations per a time period, the speed of rotation, etc. As shown in FIG. 8, in some embodiments, the shaft 41*a* can be rotatably coupled to a flange 90*a* such that the flange 90*a* rotates at the same rotational velocity as the shaft 41*a*, and/or the shaft 41*b* can be rotatably coupled to a flange 90*b* such that the flange 90*b* rotates at the same rotational velocity as the shaft 41*b* (see FIG. 8). In some embodiments, the flange 90*a* can be connected to shaft 41*a* within the housing 30, and/or the flange 90*b* can be connected to the shaft 41*b* within the housing 30. In some embodiments, a magnet 92*a* can be mounted on the flange 90*a* such that the magnet 92*a* rotates at the same rotational velocity as the flange 90*a* and/or the shaft 41*a*, and/or a magnet 92*b* can be mounted on the flange 90*b* such that the magnet 92*b* rotates at the same rotational velocity as the flange 90*b* and/or the shaft 41*b* (see FIG. 8).

In some embodiments, the exercise and therapy device 10 can include one or more sensors 94*a*, 94*b* that can detect changes in a magnetic field. In some embodiments, the sensor 94*a* can be configured to emit a signal when the first shaft 41*a* completes a rotation. In some embodiments, the sensor 94*b* can be configured to emit a signal when the second shaft 41*b* completes a rotation. In some embodiments, the sensor 94*a* can emit a signal when the magnet 92*a* passes within a predetermined distance of the sensor 94*a*. In some embodiments, the sensor 94*b* can emit a signal when the magnet 92*b* passes within a predetermined distance of the sensor 94*b*. In some embodiments, the sensor 94*a* can be positioned above the magnet 92*a*. In some embodiments, as the magnet 92*a* rotates with the shaft 41*a* and/or the flange 90*a*, the distance between the magnet 92*a* and the sensor 94*a* can change. The sensor 94*a* can be configured to emit a signal when the distance between the magnet 92*a* and the sensor 94*a* is at a minimum (i.e., when the magnet 92*a* passes by the sensor 94*a*) such that the sensor 94*a* emits a signal once per revolution of the shaft 41*a*. In some embodiments, the sensor 94*b* can be positioned above the magnet 92*b*. In some embodiments, as the magnet 92*b* rotates with the shaft 41*b* and/or the flange 90*b*, the distance between the magnet 92*b* and the sensor 94*b* can change. The sensor 94*b* can be configured to emit a signal when the distance between the magnet 92*b* and the sensor 94*b* is at a minimum (i.e., when the magnet 92*b* passes by the sensor 94*b*) such that the sensor 94*b* emits a signal once per revolution of the shaft 41*b*. In some embodiments, the exercise and therapy device 10 can receive and utilize the signals emitted by the sensors 94*a*, 94*b* to calculate and/or record information regarding the rotation of the shafts 41*a*, 41*b* and the rollers 40*a*, 40*b* such as the total number of rotations in an exercise session, the number of rotations per a time period, the speed of rotation, etc. In some embodiments, the exercise and therapy device 10 can display some or all of this information to the user, for example, through one or more displays 50.

Figure 4:
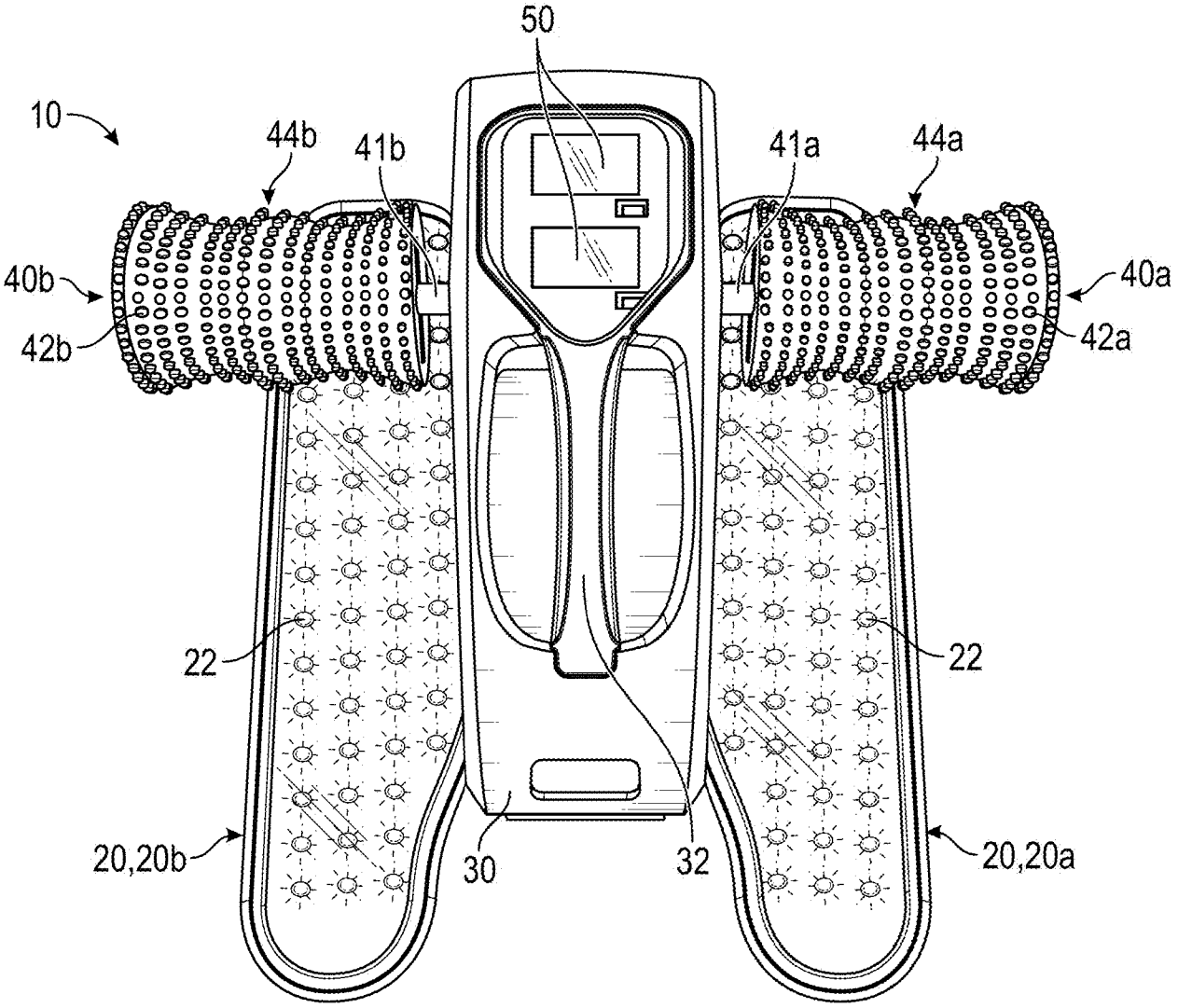
FIG. 4 illustrates a top view of the exercise and therapy device of FIG. 1.
Figure 5:
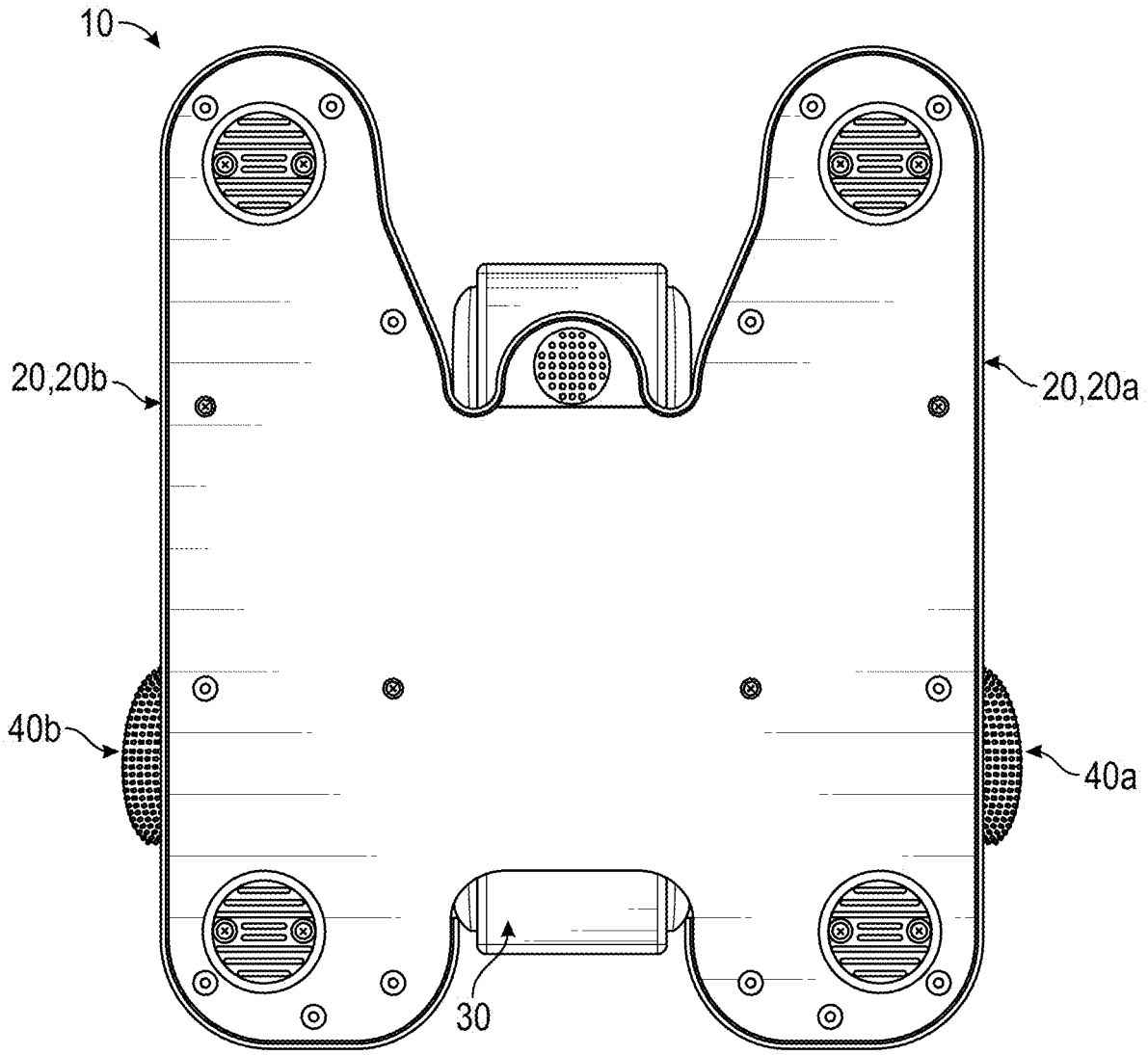
FIG. 5 illustrates a bottom view of the exercise and therapy device of FIG. 1.
Figure 6:
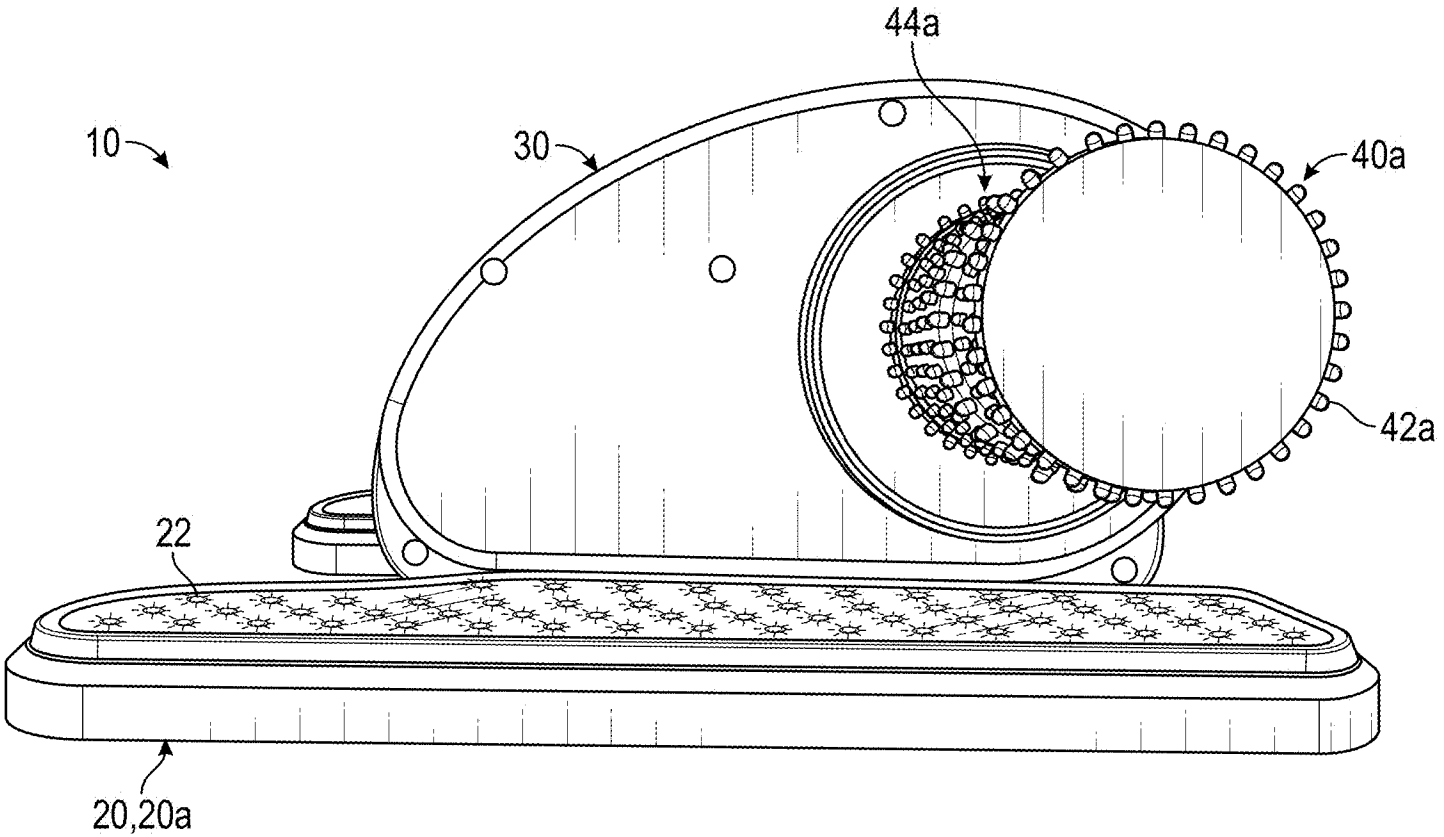
FIG. 6 illustrates a side view of the exercise and therapy device of FIG. 1.

As shown in FIGS. 1 and 4, in some embodiments, the exercise and therapy device can include one or more display (s) 50. In some embodiments, the one or more display(s) 50 can show information relating to the rotation of the rollers 40*a*, 40*b* and/or the rotation of the shafts 41*a*, 41*b* such as the total number of rotations, the number of rotations per a time period, the speed of rotation, etc. In some embodiments, the one or more display(s) can additionally or alternatively show information such as estimated calories burned and/or the time remaining in an exercise session. In some embodiments the one or more display(s) can additionally or alternatively display a first numerical value representing the resistance acting against the rotation of the first roller and/or display a second numerical value representing the resistance acting against the rotation of the second roller. In some embodiments, the one or more display(s) 50 can be positioned on a top surface of the housing 30 such that a user can easily view the one or more display(s) 50. Displaying exercise information to the user can gamify the exercise experience by providing real time feedback and progress indicators which can increase a user's motivation to continue exercising. In some embodiments, the exercise and therapy device 10 can include two displays 50 such that one display 50 can display information relating to the first roller 40*a*, and a second display 50 can display information relating to the second roller 40*b*. For example, one display 50 can display the number of rotations of the first roller 40*a* while the other display 50 can display the number of rotations of the second roller 40*b*. In some embodiments, the exercise and therapy device can include a singular display 50 that can display information relating to one or both rollers 40*a*, 40*b*. In some embodiments, the one or more display(s) 50 can be switched between a plurality of modes that can display different information and/or combinations of information to a user about the exercise and therapy device 10 and/or his or her current exercise session.

Figure 2:
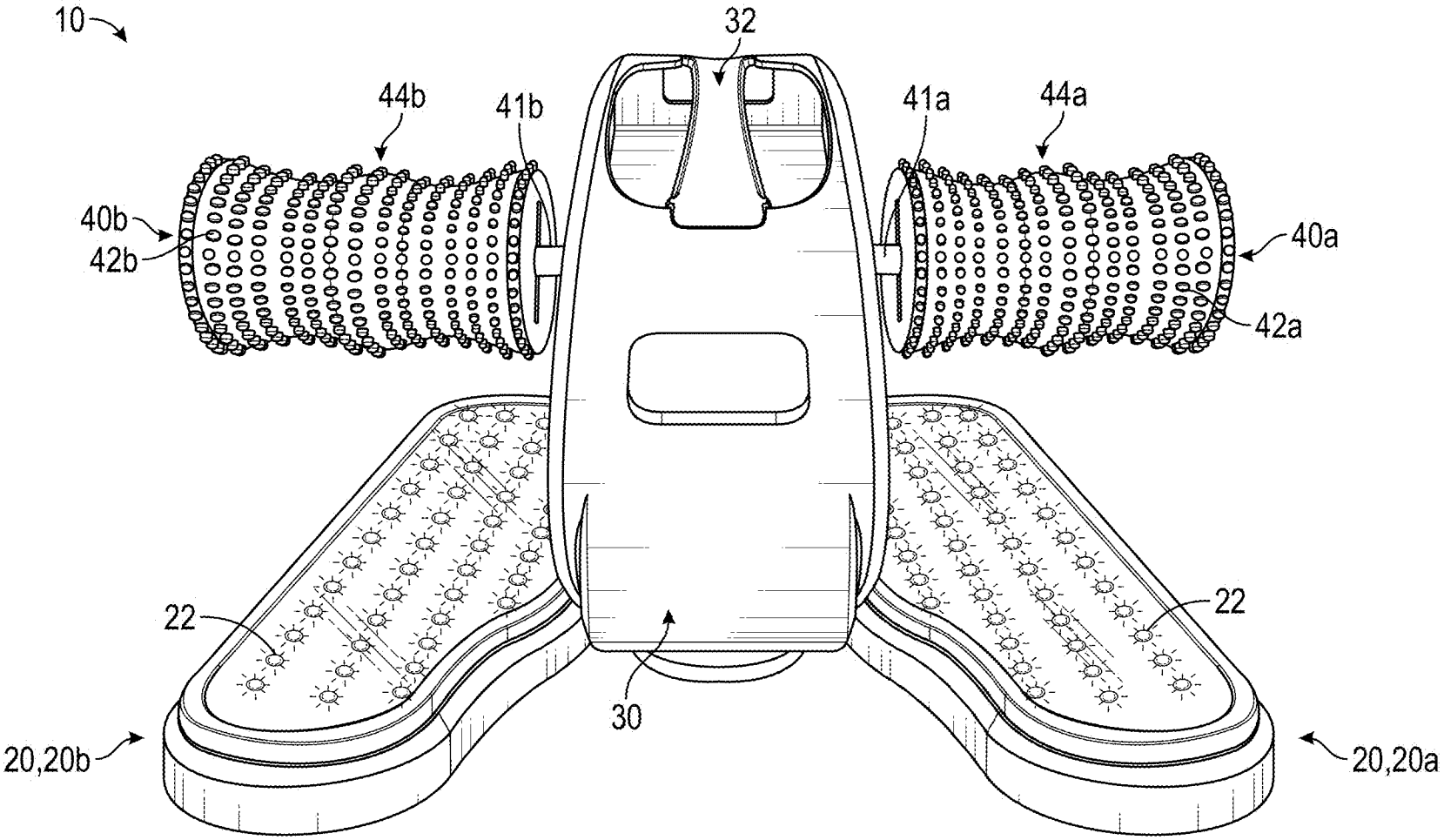
FIG. 2 illustrates a front view of the exercise and therapy device of FIG. 1.
Figure 3:
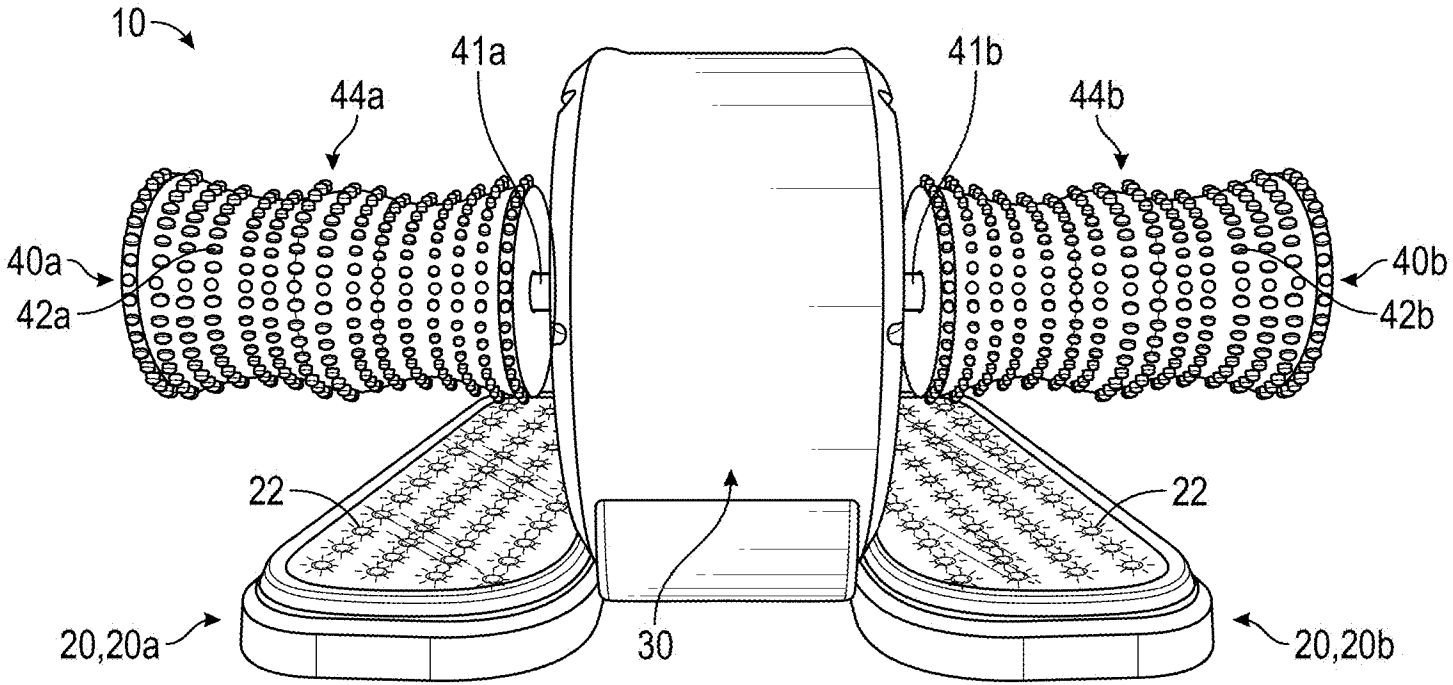
FIG. 3 illustrates a rear view of the exercise and therapy device of FIG. 1.

As shown in FIGS. 1, 2, and 4, in some embodiments, the exercise and therapy device 10 can include a handle 32 configured to be gripped by a user to allow a user to pick up and/or move the device 10. In some embodiments, the handle 32 can be connected to the housing 30. In some embodiments, the handle 32 can be positioned proximate a top surface of the housing 30 such that the handle 32 is positioned above the support surface. This can increase the ease with which a user can pick up the exercise and therapy device 10 by allowing a user to grab the handle 32 without having to reach down to the support surface.

Figure 9:
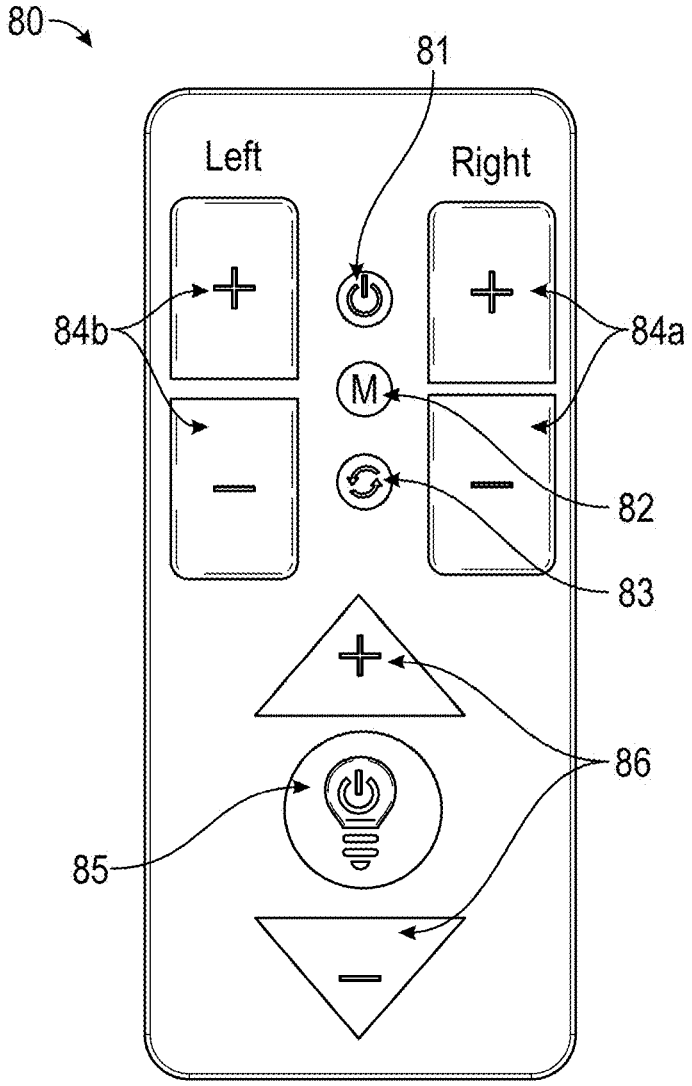
FIG. 9 illustrates a top view of an embodiment of a remote.

FIG. 9 illustrates a top view of an embodiment of a remote 80 that can be used with any embodiments of the exercise device 10 disclosed herein. In some embodiments, a user can interact with the remote 80 to control and/or affect various aspects of the exercise and therapy device 10 such as powering the device 10 on and/or off, changing the resistance acting against rotation of the rollers 40*a*, 40*b*, changing the information shown on the display(s) 50, resetting the exercise and therapy device 10, turning the light emitters 22 on and/or off, increasing and/or decreasing the intensity of the light emitters 22, etc. The remote 80 can include a plurality of inputs (e.g. buttons, touch screens, knobs, switches, levers, etc.) that a user can engage with to control and/or affect various aspects of the exercise and therapy device 10. In some embodiments, the remote 80 can include an input 81 which can be interacted with to power the exercise and therapy device 10 on and/or off. In some embodiments, the remote 80 can include an input 82 which can be interacted with to change the mode of the displays such that a user can change the information displayed by the display(s) 50. In some embodiments, the remote 80 can include an input 83 which can be interacted with to reset the exercise and therapy device 10. Resetting the exercise and therapy device 10 can stop operation of the exercise and therapy device 10, restart the current exercise session on the exercise and therapy device 10, erase data from the current exercise session from the exercise and therapy device 10, return the resistance of each roller 40*a*, 40*b* to a baseline or predetermined value, return the intensity of the light emitters 22 to a baseline or predetermined value, etc. In some embodiments, the remote 80 can include input(s) 84*a* that can be interacted with to increase and/or decrease the resistance acting against rotation of first roller 40*a*. In some embodiments, the remote 80 can include input(s) 84*b* which can be interacted with to increase and/or decrease the resistance acting against rotation of the second roller 40*b*. In some embodiments, the remote can include inputs 85, 86 which can be interacted with by a user to turn the light emitters 22 on and off and/or change the intensity of the light emitted by the light emitters 22. In some embodiments, any combination or controls and/or functions that can be performed by the remote 80 can be performed by the exercise and therapy device 10. For example, any of the inputs located on the remote 80 can additionally or alternatively be located on the exercise and therapy device 10.

Figure 10:
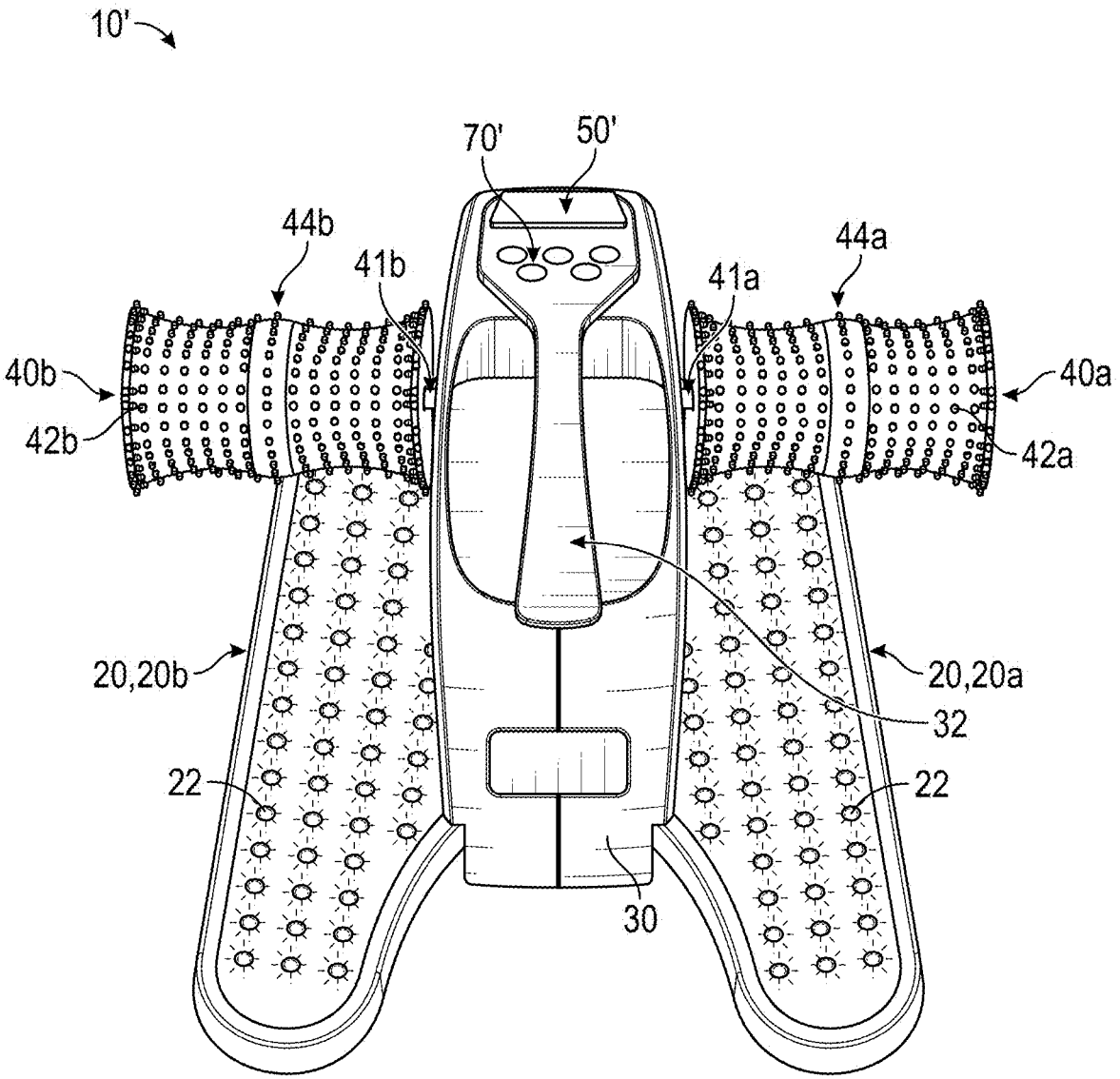
FIG. 10 illustrates a front, top perspective view of another embodiment of an exercise and therapy device.

FIG. 10 illustrates a top perspective view of another embodiment of an exercise and therapy device 10'. The exercise and therapy device 10' can be substantially similar or identical to the exercise and therapy device 10 as indicated by the use of common reference numbers, except with regard to the display 50' and controls 70'. In some embodiments, the display 50' can display information similar or identical to the display 50. In some embodiments, the display 50' can include a singular screen. In some embodiments, the controls 70' can control and/or affect various aspects of the exercise and therapy device 10 such as powering the device 10 on and/or off, changing the resistance of the rollers 40*a*, 40*b*, changing the information shown on the display(s) 50, resetting the exercise and therapy device 10, turning the light emitters 22 on and/or off, increasing and/or decreasing the intensity of the light emitters 22, etc. In some embodiments, the controls 70' can include a plurality of inputs similar or identical to the inputs of the remote 80.

Figure 11A:
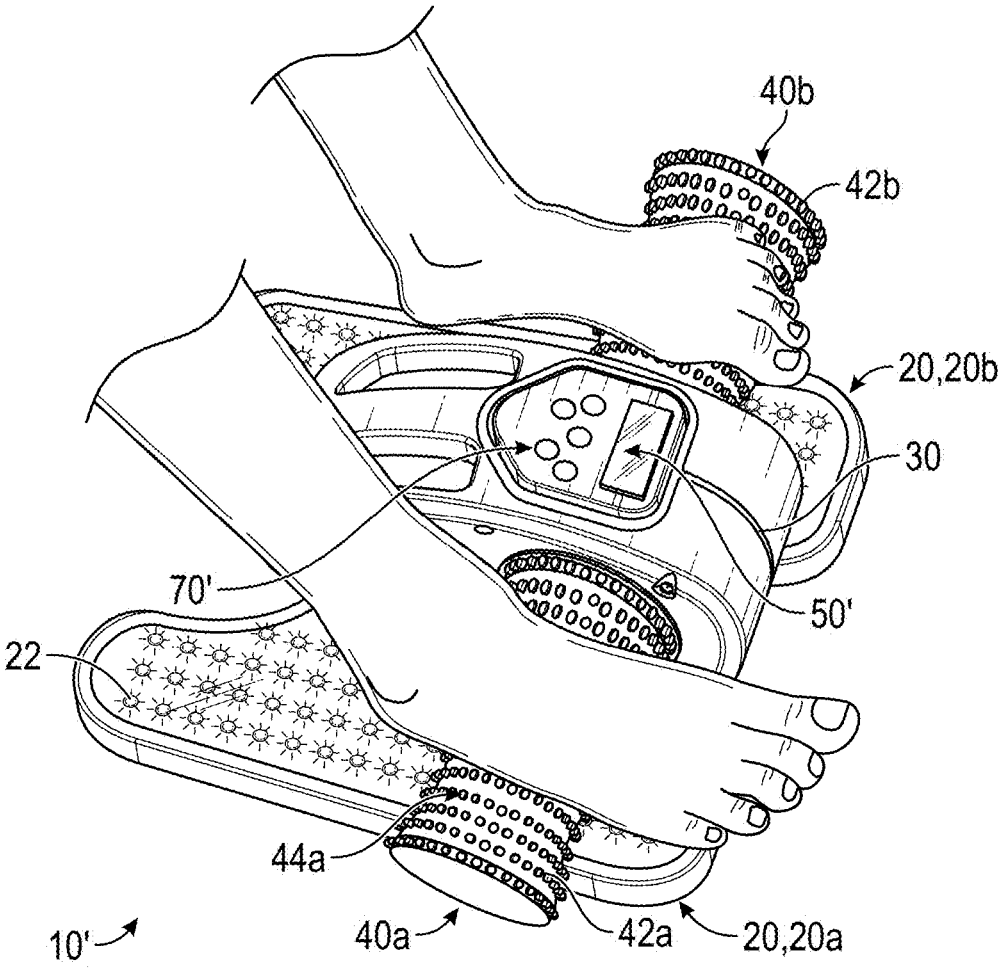
FIGS. 11A-11C illustrate side, top perspective views of the exercise and therapy device of FIG. 10 in use by a user.
Figure 11B:
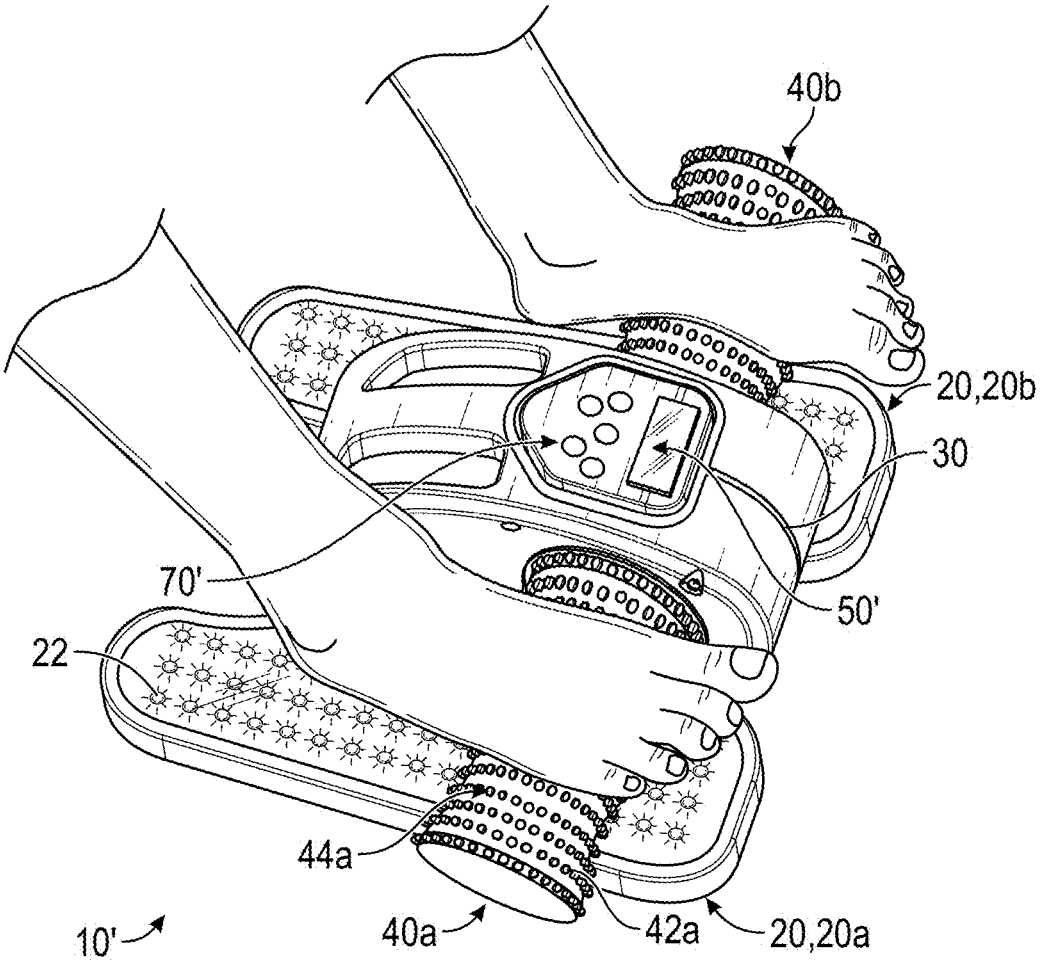
Figure 11C:
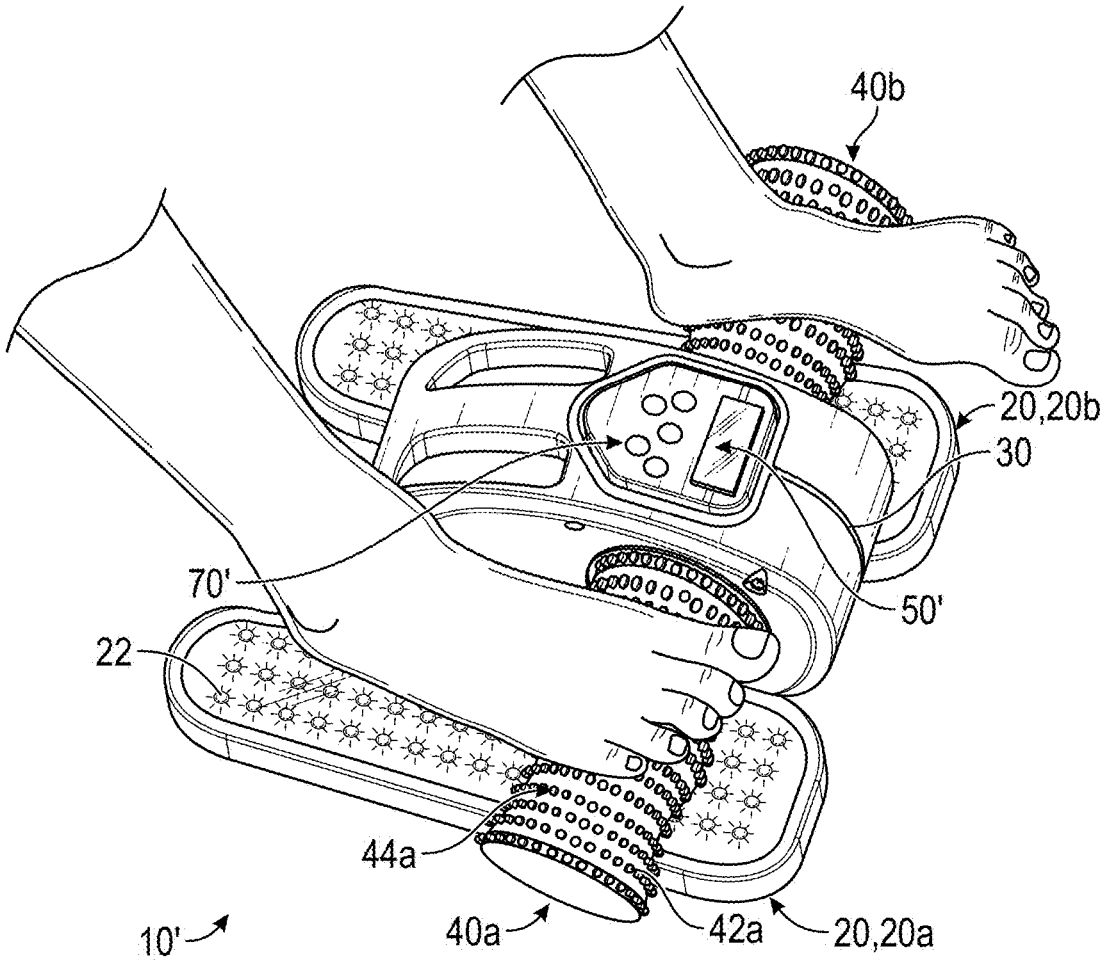

FIGS. 11A-11C illustrate the exercise and therapy device 10' during operation. Operation of the exercise and therapy device 10' can be substantially similar or identical to operation of the exercise and therapy device 10 and/or any of the other example exercise and therapy devices disclosed herein. Any of the benefits described from use of the exercise and therapy device 10' can also apply to the exercise and therapy device 10 and/or any of the other example exercise and therapy devices disclosed herein.

In some embodiments, a user can place a foot on the contact surface 44*a* of the roller 40*a* or the contact surface 44*b* of the roller 40*b* such that a bottom surface of the user's foot contacts the contact surface 44*a* or 44*b*. For example, a user's left foot can contact either the roller 40*a* or 40*b*, a user's right foot can contact either the roller 40*a* or 40*b*, both the left and the right foot can contact the rollers 40*a*, 40*b* simultaneously, and/or one foot can contact one roller 40*a* or 40*b* at a time. A user can place a foot on the contact surface 44*a* or 44*b* at any angle relative to the ground to accommodate user preference and increase user comfort while using the exercise and therapy device 10'. For example, a user can place a foot on the contact surface 44*a* or 44*b* such that the bottom of the user's foot is substantially parallel to the ground, a user can place a foot on the contact surface 44*a* or 44*b* such that the bottom of the user's foot is substantially perpendicular to the ground, or a user can place a foot on the contact surface 44*a* or 44*b* such that the bottom of the user's foot forms an angle between 0 degrees and 180 degrees with the ground.

A user can move his or her foot forward and backward while the foot contacts the contact surface 44*a* or 44*b* to exert a force on the roller 40*a* or 40*b* which can rotate the roller 40*a* or 40*b* forward and backward to exercise the user's foot and/or leg, which can improve circulation, facilitate muscle growth, increase strength, increase balance, increase dexterity, and/or improve rehabilitation from an injury. In some embodiments, a user can place one foot on each roller 40*a*, 40*b* simultaneously and move both feet forward and backward while each foot contacts a different contact surface 44*a*, 44*b* such that both rollers 40*a*, 40*b* are rotated forward and backward. In some embodiments, the user can articulate one or both legs toward his or her body in a flexion motion to rotate the roller 40*a* and/or 40*b* toward his or her body. The user can articulate one or both legs away from his or her body in an extension motion to rotate the roller 40*a* and/or 40*b* away from his or her body. The user can alternate between this flexion and extension motion to alternate rotating the roller 40*a* and/or 40*b* away from and toward the body. In some embodiments, the user can move both feet and/or legs in the same direction simultaneously. In some embodiments, the user can move his or her feet and/or legs in opposite directions such that one leg is articulating in a flexion motion while the other leg is articulating in an extension motion such that the rollers 40*a* and 40*b* rotate in opposite directions simultaneously. Articulating the user's legs in the same direction or in opposite directions simultaneously can enhance flexibility, coordination, strength, and/or balance of the user. Permitting a user to rotate each roller 40*a*, 40*b* independently by moving his or her legs independently can permit independent bilateral lower-body movement which can promote neuroplasticity, prevent or diminish muscular atrophy, aid in diabetes treatment, and improve circulation to the lower body.

As the user moves his or her foot to rotate the roller 40*a* or roller 40*b*, different portions of the contact surface 44*a* or 44*b* and/or the surface features 42*a* or 42*b* can contact different portions of the user's foot, massaging the foot. For example, a user can initially place his or her foot so that his or her toes are in contact with the contact surface 44*a* or 44*b*. The user can then move his or her foot forward away from his or her body such that the roller 40*a* or 40*b* rotates forward until the user's heel is in contact with the contact surface 44*a* or 44*b*. The user can then move his or her foot backward toward his or her body such that the roller 40*a* or 40*b* rotates backward until the user's toes are in contact with the contact surface 44*a* or 44*b*. In this manner, any portion of the bottom of the user's foot between and/or including his or her toes and heel can contact the contact surface 44*a* or 44*b* such that any portion of the bottom of the user's foot can be massaged by the contact surface 44*a* or 44*b* and/or surface features 42*a* or 42*b*. This can increase blood circulation, reduce pain, decrease muscle tension, stimulate nerves, stimulate key reflexology points, and/or improve user comfort during use of the exercise and therapy device 10'. Additionally or alternatively, it can aid in the treatment of neuropathy, plantar fasciitis, diabetes, circulatory dysfunction, and/or muscular atrophy.

A user can adjust the resistance of the roller 40*a* and/or the roller 40*b* during operation of the exercise and therapy device 10' or any other example exercise and therapy device disclosed herein as described above with reference to FIGS. 7-8. A user can adjust the resistance acting against the rotation of the roller 40*a* and/or roller 40*b* to adjust the force required to rotate the roller 40*a* and/or 40*b*. This can allow a user to adjust the level of difficulty of exercise for each foot and/or leg individually which can help equalize the strength or dexterity of both feet and/or legs, help recover from an injury to one foot and/or leg, and/or help during the recovery from a stroke.

In some embodiments, a user can place one or more legs on the contact surfaces 44*a* or 44*b* of the rollers 40*a* or 40*b* in addition to or instead of a foot to exercise and/or massage the user's leg(s). For example, a user can position his or her leg such that the back of a user's calf or thigh contacts the contact surface 44*a* or 44*b*. A user can move his or her leg in a similar manner to that described above to exercise and/or massage his or her calf or thigh using the contact surface 44*a* or 44*b*, surface features 42*a* or 42*b*, and/or roller 40*a* or 40*b*.

Figure 12:
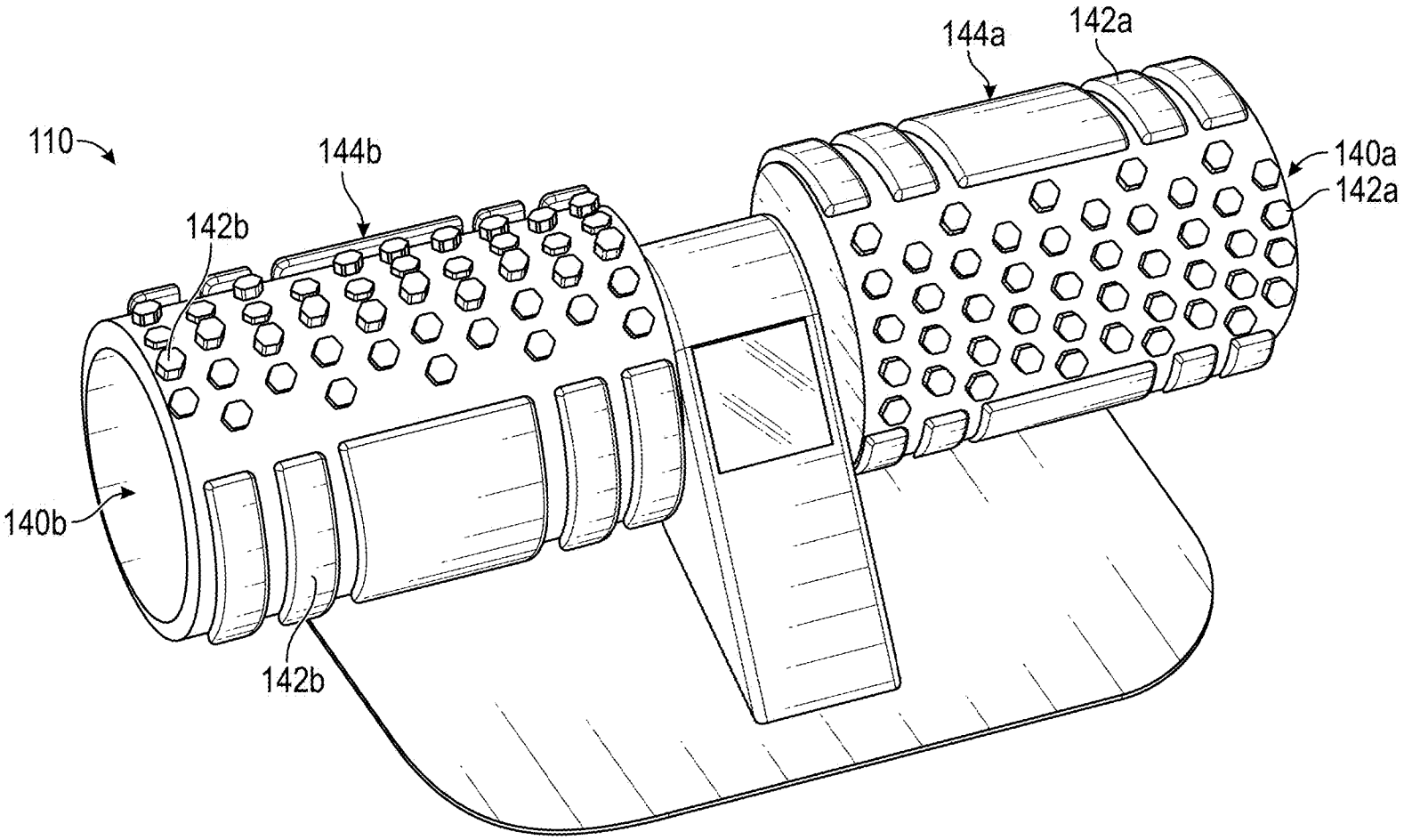
FIG. 12 illustrates a front, top perspective view of another embodiment of an exercise and therapy device.

FIG. 12 illustrates a front, top perspective view of another embodiment of an exercise and therapy device 110 which may include similar structural and/or operational features to any of the other example exercise and therapy devices disclosed herein. The exercise and therapy device 110 can include rollers 140*a*, 140*b*, contact surfaces 144*a*, 144*b*, and/or surface features 142*a*, 142*b*. The rollers 140*a*, 140*b* can be substantially cylindrical in shape. The rollers 140*a*, 140*b* can be hollow. The roller 140*a* can include contact surface 144*a*, and/or the roller 140*b* can include contact surface 144*b*. The contact surfaces 144*a*, 144*b* can include surface features 142*a*, 142*b*. The surface features 142*a*, 142*b* can include a plurality of projections. The surface features 142*a*, 142*b* can have a shape that is hexagonal, rectangular, circular, or any other appropriate shape. In some embodiments, different portions of the contact surfaces 144*a*, 144*b* can include surface features 142*a*, 142*b* with different shapes. For example, one portion of the contact surface 144*a*, 144*b* can include hexagonal surface features 142*a*, 142*b* while other portions of the contact surfaces 144*a*, 144*b* can include rectangular surface features 142*a*, 142*b*.

Figure 13:
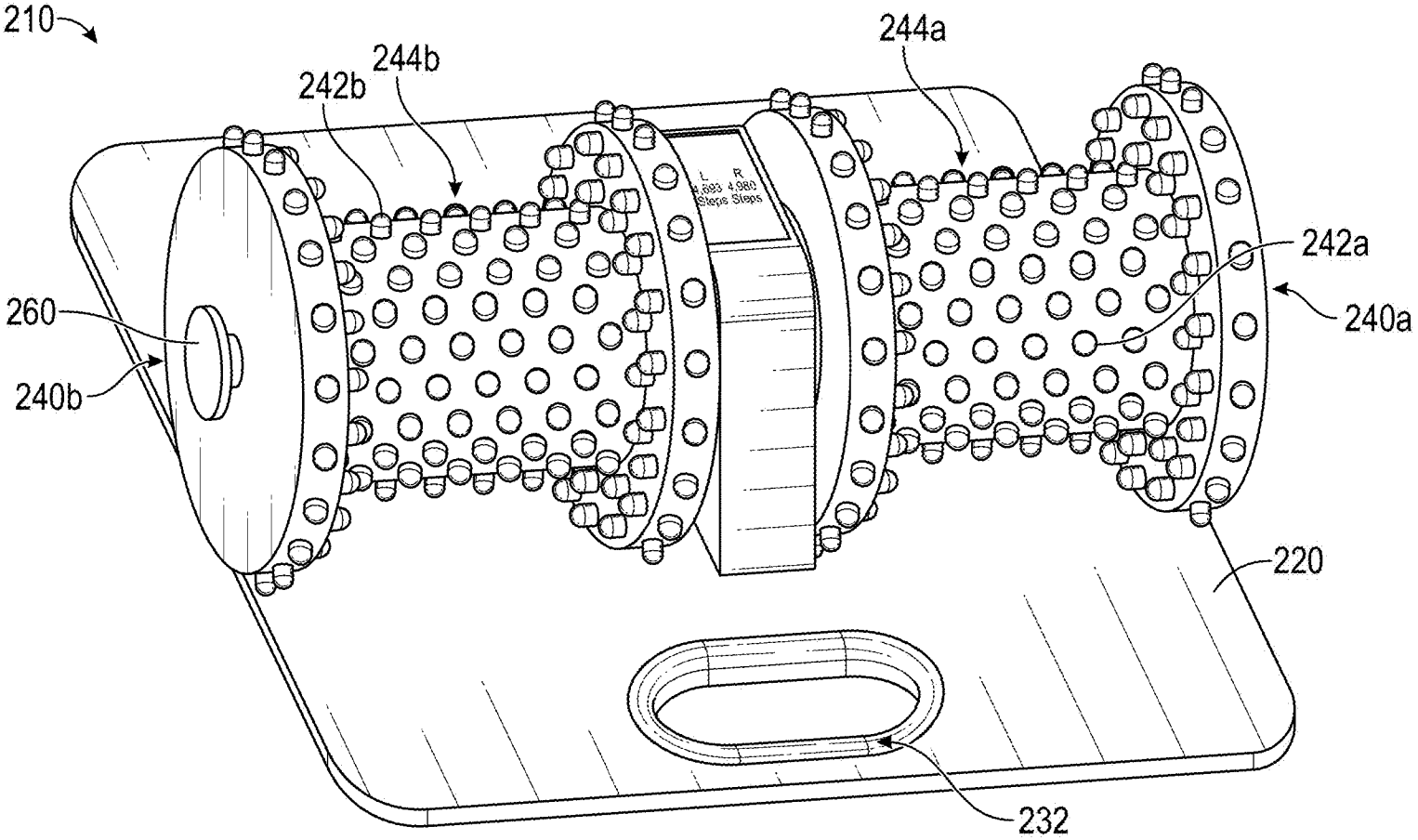
FIG. 13 illustrates a front, top perspective view of another embodiment of an exercise and therapy device.

FIG. 13 illustrates a front, top perspective view of another embodiment of an exercise and therapy device 210 which may include similar structural and/or operational features to any of the other example exercise and therapy devices disclosed herein. The exercise and therapy device 210 can include rollers 240*a*, 240*b*, contact surfaces 244*a*, 244*b*, surface features 242*a*, 242*b*, controls 260, a base 220, and/or handle 232. The rollers 240*a*, 240*b* can be approximately cylindrical in shape with top and bottom ends that have a greater diameter than inner portions of the rollers 240*a*, 240*b*. The roller 240*a* can include contact surface 244*a*, and/or the roller 240*b* can include contact surface 244*b*. The contact surfaces 244*a*, 244*b* can include surface features 242*a*, 242*b*. The surface features 242*a*, 242*b* can include a plurality of projections arranged on the contact surfaces 244*a*, 244*b*. In some embodiments, a portion of the surface features 242*a*, 242*b* can extend radially from the rollers 240*a*, 240*b*. In some embodiments, a portion of the surface features 242*a*, 242*b* can extend along a longitudinal axis of the rollers 240*a*, 240*b*. The controls 260 can be interacted with to adjust the resistance acting against rotation of the rollers 240*a*, 240*b*. The controls 260 can be knobs. The controls 260 can be positioned on the rollers 240*a*, 240*b*. The handle 232 can be positioned on the base 220 of the exercise and therapy device 210. The handle 232 can increase the ease with which the exercise and therapy device 210 can be picked up and moved.

Figure 14:
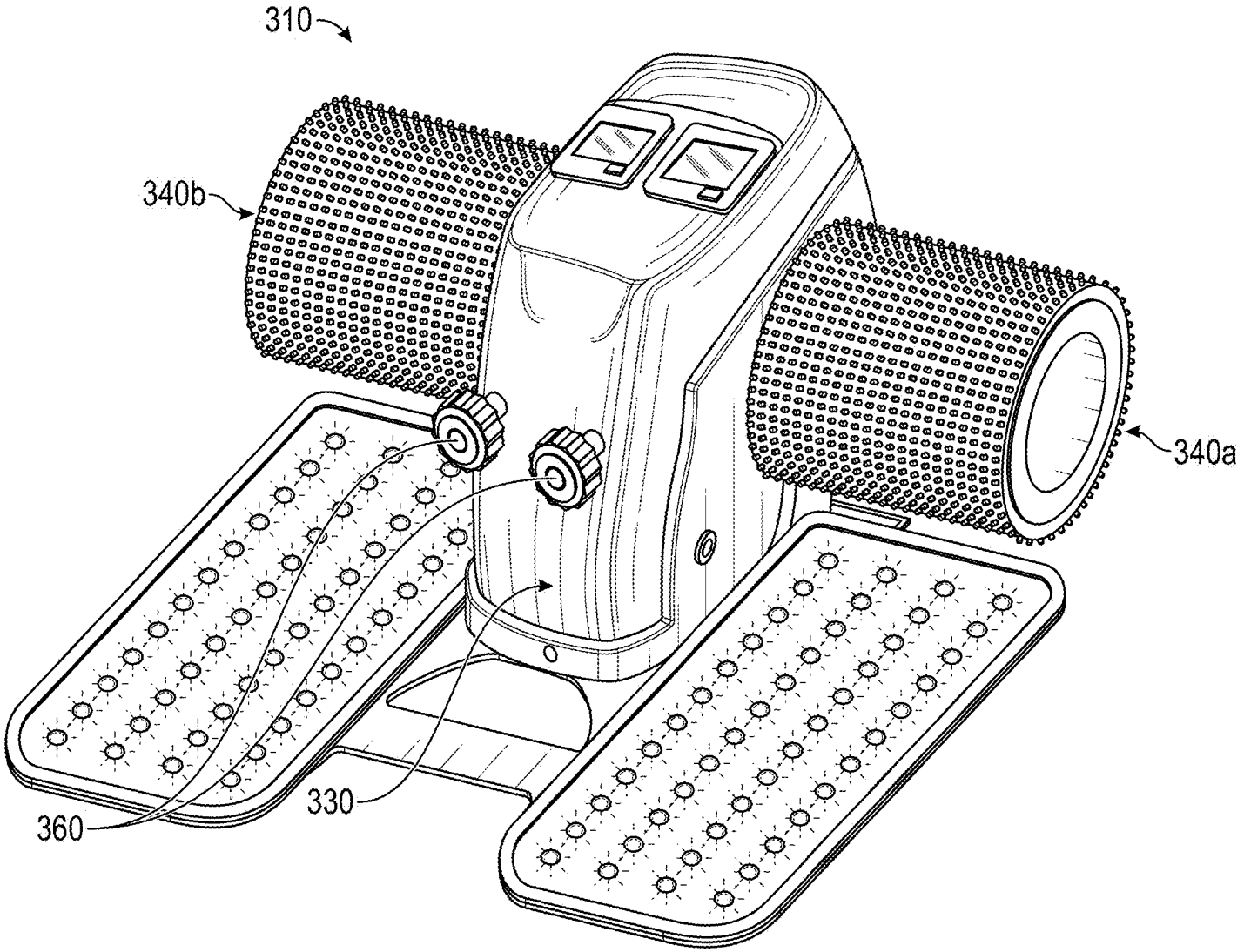
FIG. 14 illustrates a front, top perspective view of another embodiment of an exercise and therapy device.

FIG. 14 illustrates a front, top perspective view of another embodiments of an exercise and therapy device 310 which may include similar structural and/or operational features to any of the other example exercise and therapy devices disclosed herein. The exercise and therapy device 310 can include rollers 340*a*, 340*b*, a housing 330 and/or controls 360. The controls 360 can be interacted with to adjust the resistance acting against rotation of the rollers 340*a*, 340*b*. The controls 360 can be knobs. The controls 360 can be positioned on a front surface of the housing 330.

Additional Considerations and Terminology

Although this disclosure has been described in the context of certain examples, it will be understood by those skilled in the art that the present disclosure extends beyond the specifically disclosed examples to other alternative examples and/or uses of the disclosure and obvious modifications and equivalents thereof. In addition, while a number of variations of the disclosure have been shown and described in detail, other modifications, which are within the scope of this disclosure, will be readily apparent to those of skill in the art based upon this disclosure. It is also contemplated that various combinations or subcombinations of the specific features and aspects of the examples may be made and still fall within the scope of the disclosure. Accordingly, it should be understood that various features and aspects of the disclosure can be combined with or substituted for one another in order to form varying modes of the disclosed.

Features, materials, characteristics, or groups described in conjunction with a particular aspect, or example are to be understood to be applicable to any other aspect, or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing examples of devices or systems. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate embodiments can also be implemented in combination in a single embodiments. Conversely, various features that are described in the context of a single embodiments can also be implemented in multiple embodiments separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other embodiments. Those skilled in the art will appreciate that the actual steps taken in the processes illustrated and/or disclosed may differ from those shown in the figures. Depending on the system, certain of the steps described above may be removed, others may be added. Furthermore, the features and attributes of the specific examples disclosed above may be combined in different ways to form additional examples of systems, all of which fall within the scope of the present disclosure. Also, the separation of various system components in the embodiments described above should not be understood as requiring such separation in all embodiments, and it should be understood that the described components and systems can generally be integrated together in a single product or packaged into multiple products.

Conditional language used herein, such as, among others, "can," "could," "might," "may," "e.g.," and the like, unless specifically stated otherwise, or otherwise understood within the context as used, is generally intended to convey that certain features, elements, and/or steps are optional. Thus, such conditional language is not generally intended to imply that features, elements, and/or steps are in any way required. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list. Further, the term "each," as used herein, in addition to having its ordinary meaning, can mean any subset of a set of elements to which the term "each" is applied.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" refers to an amount that is within less than 10% of the stated amount. As another example, in certain embodiments, the terms "generally parallel" and "substantially parallel" refer to a value, amount, or characteristic that departs from exactly parallel by less than or equal to 10 degrees, 5 degrees, 3 degrees, or 1 degree. As another example, in certain embodiments, the terms "generally perpendicular" and "substantially perpendicular" refer to a value, amount, or characteristic that departs from exactly perpendicular by less than or equal to 10 degrees, 5 degrees, 3 degrees, or 1 degree.

While the above detailed description has shown, described, and pointed out novel features, it can be understood that various omissions, substitutions, and changes in the form and details of the devices or systems illustrated can be made without departing from the spirit of the disclosure. As can be recognized, certain portions of the description herein can be embodied within a form that does not provide all of the features and benefits set forth herein, as some features can be used or practiced separately from others. The scope of certain embodiments disclosed herein is indicated by the appended claims rather than by the foregoing description. All changes which come within the meaning and range of equivalency of the claims are to be embraced within their scope.

What is claimed is:

1. An exercise and therapy device comprising:

a base;

a housing coupled to the base;

a first shaft extending from a first side of the housing;

a second shaft extending from a second side of the housing opposite the first side of the housing, the second shaft being coaxial with the first shaft;

a first roller coupled to the first shaft such that a rotation of the first roller causes an equal and simultaneous rotation of the first shaft;

a second roller coupled to the second shaft such that a rotation of the second roller causes an equal and simultaneous rotation of the second shaft;

a first resistance that selectively impedes the rotation of the first roller; and a second resistance that selectively impedes the rotation of the second roller;

wherein:

the first and second shafts are configured to each be rotated in either a clockwise or a counter-clockwise direction;

the first shaft is rotatable independently of the second shaft and the second shaft is rotatable independently of the first shaft;

the first resistance is adjustable such that increasing the first resistance increases a force required to rotate the first roller and decreasing the first resistance decreases the force required to rotate the first roller;

the second resistance is adjustable such that increasing the second resistance increases a force required to rotate the second roller and decreasing the second resistance decreases the force required to rotate the second roller; and the first resistance and the second resistance are independently adjustable.

2. The exercise and therapy device of claim 1, further comprising:

a first friction member configured to exert a first frictional force on the first shaft; and a second friction member configured to exert a second frictional force on the second shaft;

wherein:

the first frictional force is adjustable such that increasing the first frictional force increases the first resistance and decreasing the first frictional force decreases the first resistance;

the second frictional force is adjustable such that increasing the second frictional force increases the second resistance and decreasing the second frictional force decreases the second resistance; and the first frictional force and the second frictional force are independently adjustable.

3. The exercise and therapy device of claim 2, wherein the first friction member comprises a first belt and the second friction member comprises a second belt.

4. The exercise and therapy device of claim 3, further comprising:

a first actuator configured to adjust a tension of the first belt; and a second actuator configured to adjust a tension of the second belt;

wherein:

increasing the tension of the first belt increases the first frictional force and decreasing the tension of the first belt decreases the first frictional force; and increasing the tension in the second belt increases the second frictional force and decreasing the tension in the second belt decreases the second frictional force.

5. The exercise and therapy device of claim 4, wherein:

the first actuator comprises a first arm, the first arm being configured to extend and retract;

the second actuator comprises a second arm, the second arm being configured to extend and retract;

the first belt is coupled to the first arm;

the second belt is coupled to the second arm;

extending the first arm increases the tension in the first belt and retracting the first arm decreases the tension in the first belt; and extending the second arm increases the tension in the second belt and retracting the second arm decreases the tension in the second belt.

6. The exercise and therapy device of claim 1, wherein the first roller comprises an outer surface and a plurality of projections extending outwardly away from the outer surface of the first roller, and wherein the second roller comprises an outer surface and a plurality of projections extending outwardly away from the outer surface of the second roller.

7. The exercise and therapy device of claim 1, further comprising:

a plurality of light emitters configured to emit light with a wavelength between 600 nm and 850 nm, the plurality of light emitters being positioned beneath a transparent or semi-transparent top surface of the base.

8. The exercise and therapy device of claim 1, wherein:

the first roller further comprises a first plurality of light emitters configured to emit light with a wavelength between 600 nm and 850 nm; and the second roller further comprises a second plurality of light emitters configured to emit light with a wavelength between 600 nm and 850 nm.

9. The exercise and therapy device of claim 1, wherein:

the first roller is substantially cylindrical in shape, the first roller comprising a variable diameter;

a first and second end of the first roller have a first, maximum diameter;

portions of the first roller between the first and second ends have diameters that are less than the first, maximum diameter; and a center portion of the first roller is located approximately halfway between the first and second end of the first roller and has a diameter that is greater than the diameter of portions of the first roller adjacent to the center portion.

10. The exercise and therapy device of claim 1, further comprising:

a first base portion comprising a first end and a second end; and a second base portion comprising a first end and a second end;

wherein:

the first base portion and the second base portion are positioned on opposite, lateral sides of the housing;

the first base portion is tapered such that the first end of the first base portion is narrower than the second end of the first base portion; and the second base portion is tapered such that the first end of the second base portion is narrower than the second end of the second base portion.

11. The exercise and therapy device of claim 1, further comprising:

a first base portion comprising:

a first plurality of light emitters; and a transparent or semi-transparent top surface; and a second base portion comprising:

a second plurality of light emitters; and a transparent of semi-transparent top surface;

wherein:

the first base portion and the second base portion are positioned on opposite, lateral sides of the housing; and the first plurality of light emitters and the second plurality of light emitters are configured to emit light with a wavelength between 600 nm and 850 nm.

12. The exercise and therapy device of claim 1, further comprising one or more displays configured to display a first numerical value representing the first resistance and a second numerical value representing the second resistance.

13. The exercise and therapy device of claim 1, further comprising:

a first sensor configured to emit a signal when the first shaft completes a rotation; and a second sensor configured to emit a signal when the second shaft completes a rotation.

14. A method for exercising at least a user's lower legs, comprising:

applying a first force to a first roller to rotate the first roller about a first axis extending through an axial centerline of the first roller, wherein a rotation of the first roller about the first axis extending through the axial centerline of the first roller is resisted by a first resistance force;

applying a second force to rotate a second roller about a second axis extending through an axial centerline of the second roller, wherein a rotation of the second roller about the second axis extending through the axial centerline of the second roller is resisted by a second resistance force; wherein the first axis and the second axis are coaxial; and increasing the first resistance force independently of the second resistance force to increase a force required to rotate the first roller about the first axis extending through the axial centerline of the first roller without changing the second resistance force.

15. The method of claim 14, wherein:

the first resistance force is a first frictional force and the second resistance force is a second frictional force;

applying the first force to the first roller rotates a first shaft, wherein a rotation of the first shaft is resisted by the first frictional force;

applying the second force to the second roller rotates a second shaft, wherein a rotation of the second shaft is resisted by a second frictional force; and the second frictional force is independently adjustable relative to the first frictional force.

16. The method of claim 14, further comprising emitting light between 600 nm and 850 nm, wherein the light is emitted by a plurality of light emitters.

17. A method for exercising at least a user's lower legs, comprising:

applying a first force to a first roller to rotate the first roller, wherein a rotation of the first roller is resisted by a first resistance force and wherein the first resistance force is a first frictional force;

applying a second force to rotate a second roller, wherein a rotation of the second roller is resisted by a second resistance force and the second resistance force is a second frictional force;

increasing the first resistance force independently of the second resistance force to increase a force required to rotate the first roller without changing the second resistance force; and increasing the first frictional force independently of the second frictional force to increase a force required to rotate a first shaft without changing the second frictional force, wherein increasing the first frictional force increases the first resistance force;

wherein:

applying the first force to the first roller rotates the first shaft;

a rotation of the first shaft is resisted by the first frictional force;

applying the second force to the second roller rotates a second shaft;

a rotation of the second shaft is resisted by the second frictional force; and the second frictional force is independently adjustable relative to the first frictional force.

18. The method of claim 17, further comprising:

increasing a tension of a first friction member to increase the first frictional force independently of the second frictional force.

19. The method of claim 18, wherein the first friction member comprises a belt.

20. The method of claim 18, wherein increasing the tension of the first friction member comprises extending a first actuator coupled to the first friction member.

* * * * *